US009375045B2

(12) United States Patent
Farris et al.

(10) Patent No.: US 9,375,045 B2
(45) Date of Patent: Jun. 28, 2016

(54) KNITTED COMPONENT WITH ADJUSTABLE KNITTED PORTION

(71) Applicant: NIKE, Inc., Beaverton, OR (US)

(72) Inventors: Bryan N. Farris, North Plains, OR (US); Bruce Huffa, Encino, CA (US)

(73) Assignees: Nike, Inc., Beaverton, OR (US); FabDesigns, Inc, Encino, CA (US)

( * ) Notice: Subject to any disclaimer, the term of this patent is extended or adjusted under 35 U.S.C. 154(b) by 126 days.

(21) Appl. No.: 14/035,462

(22) Filed: Sep. 24, 2013

(65) Prior Publication Data

US 2015/0082662 A1 Mar. 26, 2015

(51) Int. Cl.

| | |
|---|---|
| ***D04B 1/10*** | (2006.01) |
| ***A43B 1/04*** | (2006.01) |
| ***D04B 1/24*** | (2006.01) |
| ***A41F 9/00*** | (2006.01) |
| ***A43B 23/02*** | (2006.01) |
| ***A41F 15/00*** | (2006.01) |
| ***D04B 1/12*** | (2006.01) |

(52) U.S. Cl.

CPC . *A43B 1/04* (2013.01); *A41F 9/002* (2013.01); *A41F 15/002* (2013.01); *A43B 23/0205* (2013.01); *D04B 1/10* (2013.01); *D04B 1/123* (2013.01); *D04B 1/24* (2013.01); *A41B 2500/10* (2013.01); *A41D 2500/10* (2013.01); *D10B 2403/0311* (2013.01); *D10B 2403/0331* (2013.01); *D10B 2501/043* (2013.01)

(58) Field of Classification Search

CPC ..... D04B 1/10; D04B 1/123
USPC ..... 66/170, 171, 177, 190
See application file for complete search history.

(56) References Cited

U.S. PATENT DOCUMENTS

| | | | |
|---|---|---|---|
| 601,192 | A | 3/1898 | Woodside |
| 1,215,198 | A | 2/1917 | Rothstein |
| 1,597,934 | A | 8/1926 | Stimpson |
| 1,888,172 | A | 11/1932 | Joha |
| 1,902,780 | A | 3/1933 | Holden et al. |
| 1,910,251 | A | 5/1933 | Joha |
| 2,001,293 | A | 5/1935 | Wilson |

(Continued)

FOREIGN PATENT DOCUMENTS

| | | |
|---|---|---|
| DE | 651 061 | 10/1937 |
| DE | 870963 C | 3/1953 |

(Continued)

OTHER PUBLICATIONS

International Search Report and Written Opinion for Application No. PCT/US2014/045716, mailed on Oct. 21, 2014, 13 pages.

(Continued)

*Primary Examiner* — Shaun R Hurley
*Assistant Examiner* — Bao-Thieu L Nguyen
(74) *Attorney, Agent, or Firm* — Brinks Gilson & Lione

(57) ABSTRACT

An article includes a knitted component of unitary knit construction. The knitted component has a first edge and a second edge. The knitted component has a length that is measured between the first edge and the second edge. The length is substantially fixed. The knitted component also includes a base structure and an adjustment member that is integrally knit to the base structure. The adjustment member includes a bunched region that is configured to slide along the base structure between a first position on the knitted component and a second position on the knitted component.

23 Claims, 18 Drawing Sheets

(56) References Cited

U.S. PATENT DOCUMENTS

| | | | | |
|---|---|---|---|---|
| 2,047,724 | A | | 7/1936 | Zuckerman |
| 2,147,197 | A | | 2/1939 | Glidden |
| 2,314,098 | A | | 3/1943 | McDonald |
| 2,330,199 | A | | 9/1943 | Basch |
| 2,343,390 | A | | 3/1944 | Ushakoff |
| 2,400,692 | A | | 5/1946 | Herbert |
| 2,440,393 | A | | 4/1948 | Clark |
| 2,569,764 | A | | 10/1951 | Jonas |
| 2,586,045 | A | | 2/1952 | Hoza |
| 2,608,078 | A | | 8/1952 | Anderson |
| 2,641,004 | A | | 6/1953 | Whiting et al. |
| 2,675,631 | A | | 4/1954 | Doughty |
| 2,919,567 | A | * | 1/1960 | Loeper ..... 66/173 |
| 2,994,322 | A | | 8/1961 | Cullen et al. |
| 3,424,220 | A | * | 1/1969 | Schuerch ..... 152/339.1 |
| 3,583,081 | A | | 6/1971 | Hayashi |
| 3,694,940 | A | | 10/1972 | Stohr |
| 3,704,474 | A | | 12/1972 | Winkler |
| 3,766,566 | A | | 10/1973 | Tadokoro |
| 3,778,856 | A | | 12/1973 | Christie et al. |
| 3,952,427 | A | | 4/1976 | Von den Benken et al. |
| 3,972,086 | A | | 8/1976 | Belli et al. |
| 4,027,402 | A | | 6/1977 | Liu et al. |
| 4,031,586 | A | | 6/1977 | Von den Benken et al. |
| 4,211,806 | A | | 7/1980 | Civardi et al. |
| 4,232,458 | A | | 11/1980 | Bartels |
| 4,255,949 | A | | 3/1981 | Thorneburg |
| 4,258,480 | A | | 3/1981 | Famolare, Jr. |
| 4,317,292 | A | | 3/1982 | Melton |
| 4,373,361 | A | | 2/1983 | Thorneburg |
| 4,447,967 | A | | 5/1984 | Zaino |
| 4,465,448 | A | | 8/1984 | Aldridge |
| 4,477,928 | A | | 10/1984 | Graff |
| 4,607,439 | A | | 8/1986 | Sogabe et al. |
| 4,737,396 | A | | 4/1988 | Kamat |
| 4,750,339 | A | * | 6/1988 | Simpson, Jr. ..... D02G 3/32 2/162 |
| 4,756,098 | A | | 7/1988 | Boggia |
| 4,785,558 | A | | 11/1988 | Shiomura |
| 4,813,158 | A | | 3/1989 | Brown |
| 5,031,423 | A | | 7/1991 | Ikenaga |
| 5,095,720 | A | | 3/1992 | Tibbals, Jr. |
| 5,117,567 | A | | 6/1992 | Berger |
| 5,152,025 | A | | 10/1992 | Hirmas |
| 5,192,601 | A | | 3/1993 | Neisler |
| 5,345,638 | A | | 9/1994 | Nishida |
| 5,353,524 | A | | 10/1994 | Brier |
| 5,371,957 | A | | 12/1994 | Gaudio |
| 5,461,884 | A | | 10/1995 | McCartney et al. |
| 5,511,323 | A | | 4/1996 | Dahlgren |
| 5,572,860 | A | | 11/1996 | Mitsumoto et al. |
| 5,575,090 | A | | 11/1996 | Condini |
| 5,623,840 | A | | 4/1997 | Roell |
| 5,729,918 | A | | 3/1998 | Smets |
| 5,735,145 | A | | 4/1998 | Pernick |
| 5,746,013 | A | | 5/1998 | Fay, Sr. |
| 5,765,296 | A | | 6/1998 | Ludemann et al. |
| 5,884,419 | A | | 3/1999 | Davidowitz et al. |
| 5,996,189 | A | | 12/1999 | Wang |
| 6,029,376 | A | | 2/2000 | Cass |
| 6,032,387 | A | | 3/2000 | Johnson |
| 6,052,921 | A | | 4/2000 | Oreck |
| 6,088,936 | A | | 7/2000 | Bahl |
| 6,151,802 | A | | 11/2000 | Reynolds |
| 6,170,175 | B1 | | 1/2001 | Funk |
| 6,308,438 | B1 | | 10/2001 | Throneburg et al. |
| 6,333,105 | B1 | | 12/2001 | Tanaka et al. |
| 6,401,364 | B1 | | 6/2002 | Burt |
| 6,558,784 | B1 | | 5/2003 | Norton et al. |
| 6,588,237 | B2 | | 7/2003 | Cole et al. |
| 6,754,983 | B2 | | 6/2004 | Hatfield et al. |
| 6,910,288 | B2 | | 6/2005 | Dua |
| 6,922,917 | B2 | | 8/2005 | Kerns et al. |
| 6,931,762 | B1 | | 8/2005 | Dua |
| D517,297 | S | | 3/2006 | Jones et al. |
| 7,051,460 | B2 | | 5/2006 | Orei et al. |
| 7,056,402 | B2 | | 6/2006 | Koerwien et al. |
| 7,347,011 | B2 | | 3/2008 | Dua et al. |
| 7,441,348 | B1 | | 10/2008 | Dawson |
| 7,543,397 | B2 | | 6/2009 | Kilgore et al. |
| 7,568,298 | B2 | | 8/2009 | Kerns |
| 7,682,219 | B2 | | 3/2010 | Falla |
| 8,490,299 | B2 | | 7/2013 | Dua et al. |
| 2001/0003912 | A1 | | 6/2001 | Jackon et al. |
| 2002/0078599 | A1 | | 6/2002 | Delgorgue et al. |
| 2002/0148258 | A1 | | 10/2002 | Cole et al. |
| 2003/0126762 | A1 | | 7/2003 | Tseng |
| 2003/0191427 | A1 | | 10/2003 | Jay et al. |
| 2004/0118018 | A1 | | 6/2004 | Dua |
| 2004/0181972 | A1 | | 9/2004 | Csorba |
| 2005/0115284 | A1 | | 6/2005 | Dua |
| 2005/0193592 | A1 | | 9/2005 | Dua et al. |
| 2005/0273988 | A1 | | 12/2005 | Christy |
| 2005/0284000 | A1 | | 12/2005 | Kerns |
| 2006/0059715 | A1 | | 3/2006 | Aveni |
| 2006/0162187 | A1 | | 7/2006 | Byrnes et al. |
| 2007/0022627 | A1 | | 2/2007 | Sokolowski et al. |
| 2007/0180730 | A1 | | 8/2007 | Greene et al. |
| 2007/0294920 | A1 | | 12/2007 | Baychar |
| 2008/0017294 | A1 | | 1/2008 | Bailey et al. |
| 2008/0078102 | A1 | | 4/2008 | Kilgore et al. |
| 2008/0110048 | A1 | | 5/2008 | Dua et al. |
| 2008/0189830 | A1 | | 8/2008 | Egglesfield |
| 2008/0313939 | A1 | | 12/2008 | Ardill |
| 2009/0068908 | A1 | | 3/2009 | Hinchcliff |
| 2010/0051132 | A1 | | 3/2010 | Glenn |
| 2010/0154256 | A1 | | 6/2010 | Dua |
| 2010/0170651 | A1 | | 7/2010 | Scherb et al. |
| 2011/0030244 | A1 | | 2/2011 | Motawi et al. |
| 2011/0078921 | A1 | | 4/2011 | Greene et al. |
| 2012/0233882 | A1 | | 9/2012 | Huffa |
| 2012/0255201 | A1 | | 10/2012 | Little |

FOREIGN PATENT DOCUMENTS

| | | | |
|---|---|---|---|
| DE | 1084173 | | 6/1960 |
| DE | 19738433 | | 4/1998 |
| DE | 19728848 | | 1/1999 |
| DE | 202005008292 | U1 | 7/2005 |
| EP | 0448714 | | 10/1991 |
| EP | 0728860 | | 8/1996 |
| EP | 0758693 | | 2/1997 |
| EP | 0279950 | A2 | 8/1998 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1953279 | A2 | 8/2008 |
| EP | 1972706 | A1 | 9/2008 |
| FR | 2171172 | | 9/1973 |
| GB | 538865 | | 8/1941 |
| GB | 2018837 | A | 10/1979 |
| GB | 1603487 | | 11/1981 |
| JP | H06113905 | | 4/1994 |
| JP | H08109553 | | 4/1996 |
| JP | H11302943 | | 11/1999 |
| NL | 7304678 | | 10/1974 |
| TW | 201042106 | A | 12/2010 |
| WO | 9003744 | | 4/1990 |
| WO | 0032861 | | 6/2000 |
| WO | 0231247 | | 4/2002 |

OTHER PUBLICATIONS

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

International Search Report and Written Opinion in connection with PCT/US2009/056795 mailed on Apr. 20, 2010.

(56) References Cited

OTHER PUBLICATIONS

International Search Report and Written Opinion in connection with PCT/US2012/028576 mailed on Oct. 1, 2012.
International Search Report and Written Opinion in connection with PCT/US2012/028559 mailed on Oct. 19, 2012.
International Search Report and Written Opinion in connection with PCT/US2012/028534 mailed on Oct. 17, 2012.
International Preliminary Report on Patentability in connection with PCT/US2012/028534 mailed Sep. 17, 2013.
International Preliminary Report on Patentability in connection with PCT/US2012/028576 mailed Sep. 17, 2013.
Letter from Bruce Huffa dated Dec. 23, 2013 (71 Pages).
Office Action and Search Report, and English language translation therein, in corresponding Taiwanese Application No. 103131047, dated Mar. 1, 2016, 26 pages.

* cited by examiner

KNITTED COMPONENT WITH ADJUSTABLE KNITTED PORTION

BACKGROUND

1. Field of the Invention

The present invention relates to a knitted component and, more particularly, to a knitted component with an adjustable knitted portion.

2. Description of Related Art

This section provides background information related to the present disclosure which is not necessarily prior art.

Articles of apparel, footwear, and other articles can include one or more knitted components. The knitted component can add desirable texture to the article. The component can also be durable and strong. Moreover, manufacture of the article can be facilitated due to the efficiencies provided by the knitting process.

For example, articles of footwear can include one or more knitted components. The knitted component can at least partially define the upper of the footwear. The knitted component can be relatively lightweight and, yet, durable enough to withstand the rigors of intense exercise. These knitted articles can provide a unique and attractive appearance to the footwear. Moreover, the footwear can be manufactured efficiently.

SUMMARY

An article is disclosed that includes a knitted component of unitary knit construction. The knitted component has a first edge and a second edge. The knitted component has a length that is measured between the first edge and the second edge. The length is substantially fixed. The knitted component includes a base structure and an adjustment member that is integrally knit to the base structure. The adjustment member includes a bunched region that is configured to slide along the base structure between a first position on the knitted component and a second position on the knitted component.

Moreover, an article is disclosed that includes a strap having a first edge and a second edge and a length measured between the first edge and the second edge. The length is substantially fixed. The strap includes a knitted component of unitary knit construction. The knitted component includes a base structure that includes at least one strand. The knitted component also includes an adjustment member that is integrally knit to the base structure. The adjustment member includes a bunched region that is configured to slide along the at least one strand between a first position on the knitted component and a second position on the knitted component. The bunched region is closer to the first edge in the first position, and the bunched region is closer to the second edge in the second position.

Still further, an article of footwear is disclosed. The article of footwear includes a sole structure and an upper that is coupled to the sole structure. The article of footwear further includes a strap that is coupled to the upper. The strap has a first edge, a second edge, a third edge, and a fourth edge. The strap has a length measured between the first edge and the second edge, and the length is substantially fixed. The strap includes a knitted component of unitary knit construction. The knitted component includes a base structure that includes at least one strand. The at least one strand has a first end and a second end. The at least one strand also includes a middle portion between the first end and the second end. The middle portion includes a plurality of turns. The knitted component also includes an adjustment member that is integrally knit to the base structure. The adjustment member includes a plurality of knitted courses. The at least one strand extends in a serpentine pattern within the adjustment member and is inlaid within respective ones of the plurality of knitted courses. The first end is disposed adjacent the third edge, and the second end is disposed adjacent the fourth edge. Each of the plurality of turns is disposed adjacent one of the first edge and the second edge. The adjustment member includes a bunched region that is configured to slide along the base structure between a first position on the knitted component and a second position on the knitted component.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

The following discussion and accompanying figures disclose a variety of concepts relating to knitted components. As will be discussed, the knitted components can include an adjustable portion that can be adjusted by the user. For example, regions of the knitted component can be smooth while other regions can be bunched. The number of bunched regions on the component can be changed by the user, and the bulkiness of the bunched regions can be changed by the user as well. Moreover, the position of the bunched region can be moved along the knitted component, and the bunched region can be retained in its selected position. This can allow the user to adjust and change the knitted component to a desirable configuration.

As will be discussed, the knitted component can have a wide variety of shapes, sizes, textures, appearances, or other characteristics. Also, the knitted component can define or can be included in a wide variety of articles without departing from the scope of the present disclosure. For example, the knitted component can at least partially define a strap, a cloth, a fabric, or other article. Also, the knitted component can be included on an article of footwear, an article of apparel, or other object without departing from the scope of the present disclosure.

Configurations of Exemplary Articles

Figure 1:
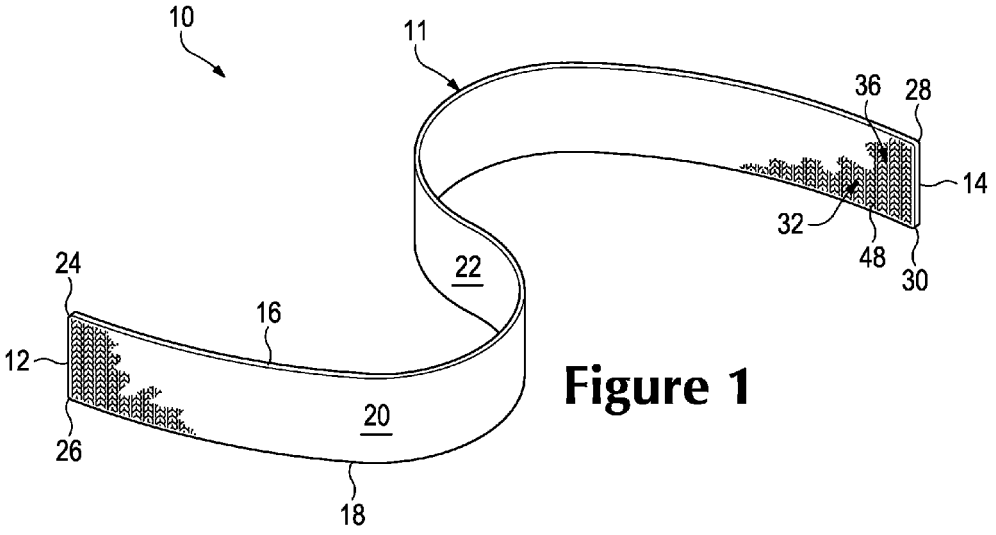
FIG. 1 is a perspective view of an article that includes a knitted component according to exemplary embodiments of the present disclosure.

Referring initially to FIG. 1, an article 10 is illustrated according to exemplary embodiments of the present disclosure. Article 10 can have a variety of shapes, sizes, and characteristics without departing from the scope of the present disclosure.

As shown in the exemplary embodiment of FIG. 1, article 10 can be elongate, or stated differently, article 10 can be relatively long, thin, and flat. As such, article 10 can be configured as a strap, belt, bandage, or other similar object.

Article 10 can be used independently and can be wrapped about a user's body in some embodiments. For example, article 10 can be wrapped about the user's wrist, ankle, or other joint to apply compression to the joint. Specifically, if the joint is sprained, article 10 can apply compression to the joint to limit movement of the joint and promote healing.

Article 10 can also be included or attached to another object. For example, article 10 can be attached to an article of footwear and can wrap about the user's body to help secure the article of footwear to the user's body. Article 10 can also be attached to an article of apparel, such as a tank top, a brassiere, a pair of pants, or other apparel, and article 10 can help support the article on the wearer's body.

Figure 2:
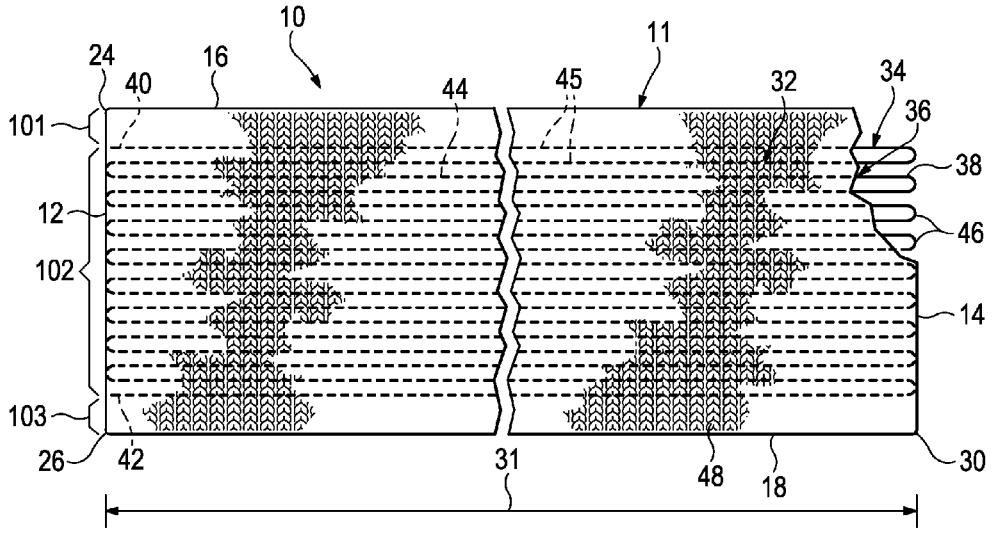
FIG. 2 is a plan view of the article of FIG. 1.

As mentioned above, article 10 can have any suitable size and shape. Thus, the embodiments shown in FIGS. 1 and 2 are merely exemplary of the size and shape of article 10. In the embodiments shown, article 10 can define a quadrilateral shape so as to include four sides and four corners, each of which will be described in greater detail below. However, it will be appreciated that article 10 can include any number of sides or edges, and article 10 can include any number of corners where the sides intersect. The sides can be disposed at any angle relative to each other. Also, it will be appreciated that article 10 can define a rounded shape, such as a circle, an oval, or other rounded shape.

More specifically, as shown in the plan view of FIG. 2, article 10 can include a first edge 12, a second edge 14, a third edge 16, and a fourth edge 18. Edges 12, 14, 16, 18 can be disposed at any suitable angle relative to each other. Thus, article 10 can define a rectangle, a parallelogram, or other quadrilateral. Also, first edge 12 and third edge 16 can intersect at a first corner 24, first edge and fourth edge 18 can intersect at a second corner 26, second edge 14 and third edge 16 can intersect at a third corner 28, and second edge 14 and fourth edge 18 can intersect at fourth corner 30.

Moreover, article 10 can be largely rectangular as shown in FIG. 2. As such, first edge 12 and second edge 14 can be disposed substantially parallel to each other on opposite sides of article 10. Third edge 16 and fourth edge 18 can both extend between first edge 12 and second edge 14. Third edge 16 and fourth edge 18 can also be substantially parallel to each other and can be substantially perpendicular to the first and second edges 12, 14.

Third edge 16 and fourth edge 18 can be substantially longer than the first and second edges 12, 14. Thus, third edge 16 and fourth edge 18 can define a length 31 of article 10 as shown in FIG. 2. It will be appreciated that length 31 of article 10 can have any suitable value. First edge 12 and second edge 14 can also define opposite terminal ends of article 10.

As shown in FIG. 1, article 10 can additionally include a front face 20 and a back face 22. Article 10 can have any suitable thickness measured between front face 20 and back face 22.

Additionally, article 10 can be flexible. As such, article 10 can be wrapped about another object, can be folded, or can be otherwise flexed.

Figure 14:
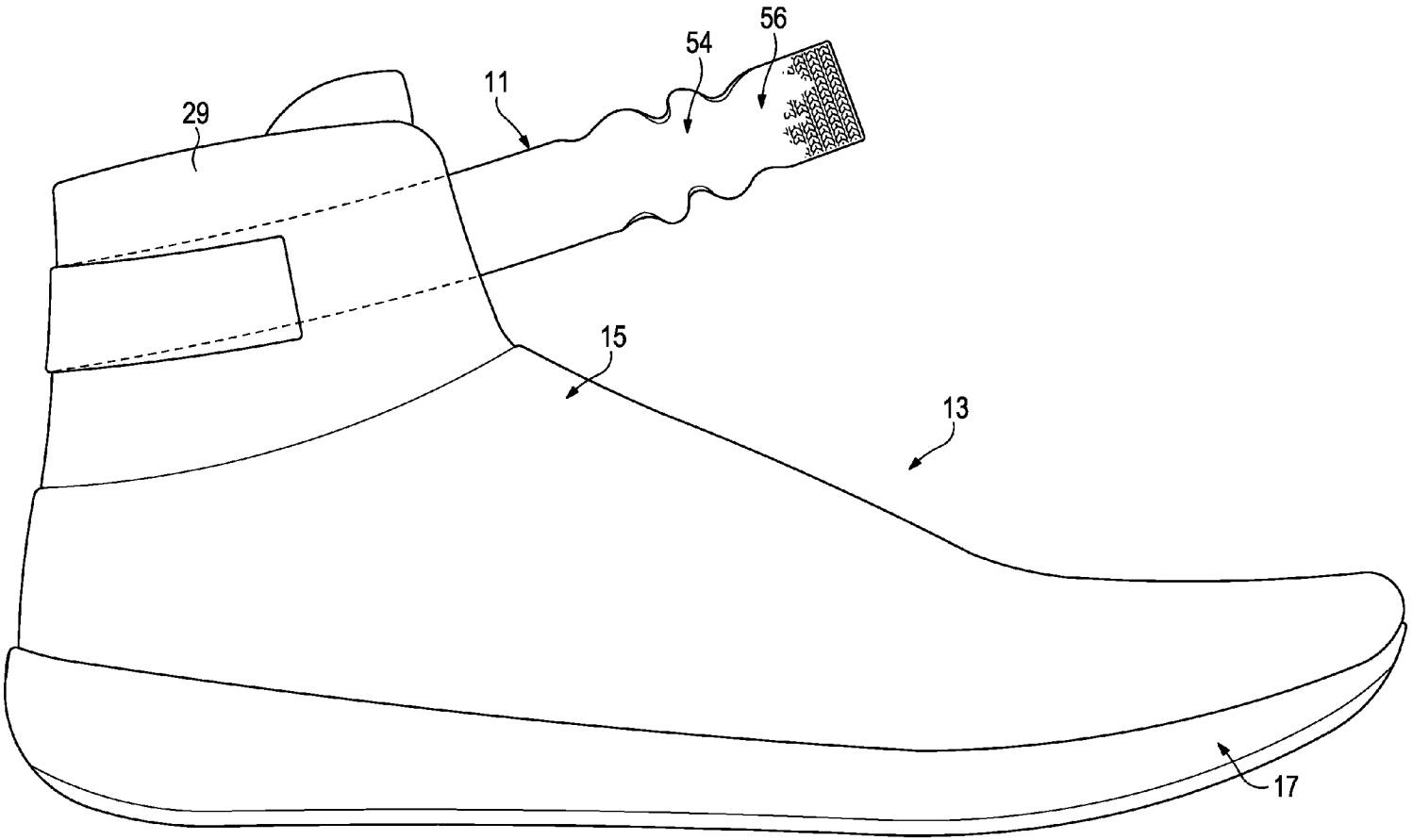
FIG. 14 is a side view of an article of footwear that includes the article of FIG. 1 according to exemplary embodiments of the present disclosure.
Figure 17:
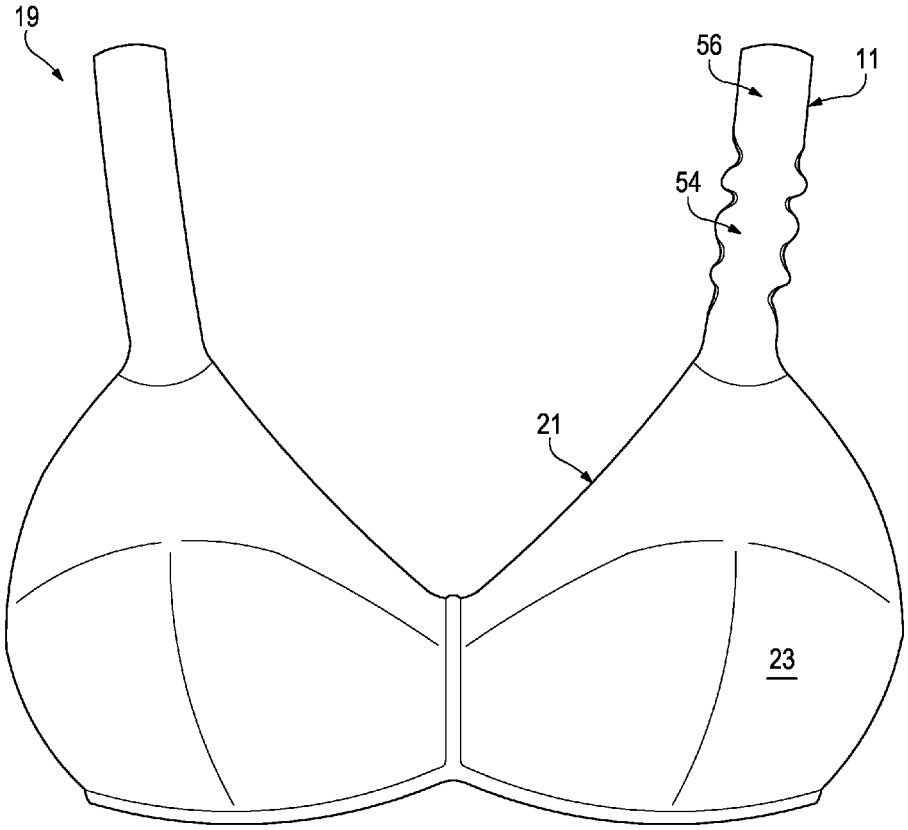
FIG. 17 is a front view of a brassiere that includes the article of FIG. 1 according to exemplary embodiments of the present disclosure.
Figure 18:
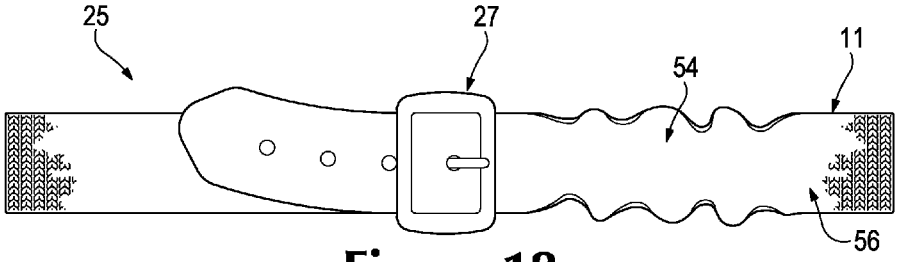
FIG. 18 is a front view of a belt that includes the article of FIG. 1 according to exemplary embodiments of the present disclosure.

It will be apparent to those having ordinary skill in the art that the shape and size of article 10 can be configured according to the intended use of article 10. For example, article 10 can be elongate as shown in FIGS. 1 and 2. As such, article 10 can at least partially define a strap 11. Strap 11 can be used independently, for example, to be wrapped around a body part. Also, strap 11 can be included on any suitable object, such as an article of footwear or article of apparel as shown in FIGS. 14, 17, and 18. It will be appreciated, however, that article 10 can be shaped, sized, and configured for objects other than a strap as well.

Moreover, article 10 can include and can be at least partially formed from a knitted component 32 from a plurality of yarns, cables, fibers, or other strands. For example, article 10 can be formed through a flat knitting process or other knitting process. As such, article 10 can be manufactured efficiently. Also, first edge 12, second edge 14, third edge 16, and fourth edge 18 of article 10 can be finished edges that are unlikely to inadvertently unravel or come undone.

Knitted component 32 can include a plurality of subcomponents as will be discussed in detail below. These subcomponents can be formed and integrally knit together such that the knitted component 32 has a unitary knit construction. Once formed, knitted component 32 can define at least a portion of article 10. Also, as will be discussed, knitted component 32 can be constructed with various adjustable features that allow the user to select and change the configuration of article 10.

As used herein, the term "unitary knit construction" means that the respective component is formed as a one-piece element through a knitting process. That is, the knitting process substantially forms the various features and structures of unitary knit construction without the need for significant additional manufacturing steps or processes. A unitary knit construction may be used to form a knitted component having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided.

Knitted component 32 can generally include a base structure 34 and an adjustment member 36. Base structure 34 and adjustment member 36 can each include respective strands, yarns, cables, or other similar flexible fibers that are integrally knit together to define a unitary knit construction as will be discussed in more detail.

Adjustment member 36 can be adjustable to change the configuration of article 10 according to the desires of the user. Base structure 34 can support such adjustment of article 10.

Figure 3:
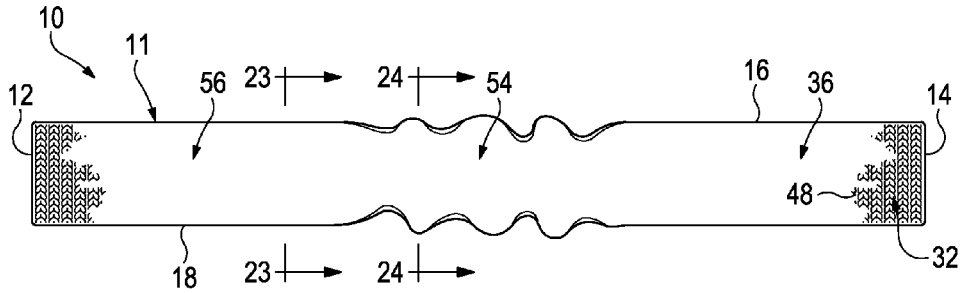
FIG. 3 is a front view of the article of FIG. 1 with a bunched region in a first position.

For example, as shown in FIGS. 1 and 2, knitted component 32 can be configured to be substantially smooth and uniform along its length 31. However, as shown in FIG. 3, portions of adjustment member 36 can be bunched or amassed together relative to base structure 34 to define a bunched region 54 having increased contouring and folds. In contrast, a smoothed region 56 is disposed on each side of bunched region 54.

Figure 4:
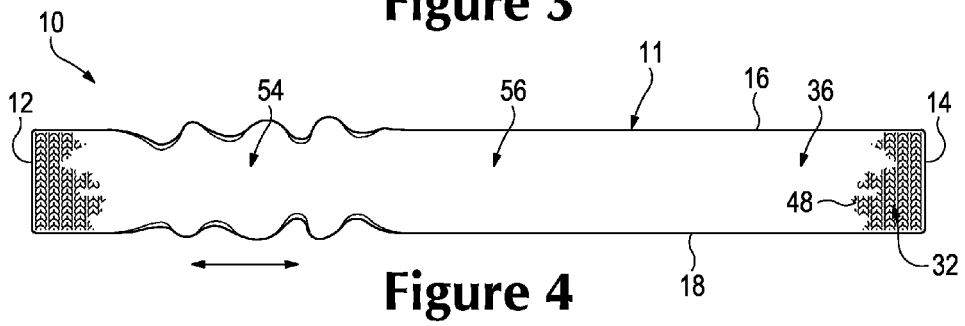
FIG. 4 is a front view of the article of FIG. 1 with the bunched region in a second position.
Figure 5:
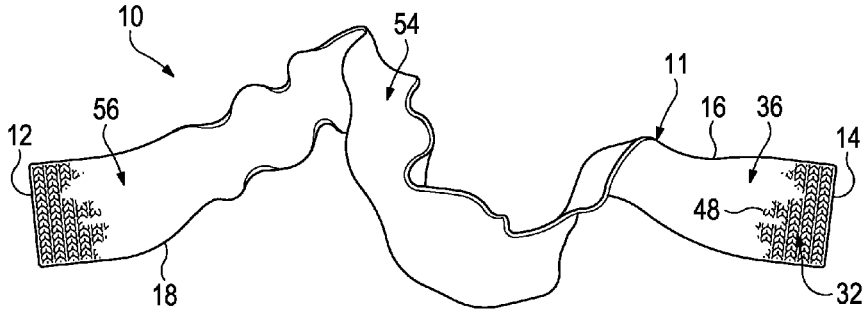
FIG. 5 is a front view of the article of FIG. 1 with the bunched region in a third position.

Bunched region 54 is shown in a first position in FIG. 3. Specifically, bunched region 54 is shown substantially centered on article 10. As shown in FIG. 4, bunched region 54 can be moved to a second position, wherein bunched region 54 is shifted to one side of article 10. In some embodiments, bunched region 54 can be moved to any area of article 10. In still further configurations represented in FIG. 5, adjustment member 36 can be bunched and amassed to such a large degree that knitted component 32 exhibits a large degree of bunching and twisting about its length.

As will be discussed, adjustment member 36 can be self-supporting such that the position and bulkiness of bunched region 54 can be retained even if the user releases the bunched region 54. Also, as will be discussed, bunched region 54 can provide one or more advantageous features to article 10. For example, bunched region 54 can provide cushioning. Stated differently, if article 10 is influenced by an external load, bunched region 54 can deflect and deform to thereby dampen the load and thereby provide cushioning. Also, if article 10 is configured to be worn against the user's body, bunched region 54 can conform comfortably against the user's body for added comfort.

Embodiments of Knitted Components

Embodiments of knitted component 32, base structure 34, and adjustment member 36 will now be discussed. As mentioned, base structure 34 and adjustment member 36 can be integrally knit together such that knitted component 32 has a unitary knit construction. Exemplary embodiments of base structure 34 and adjustment member 36 are shown in detail in FIG. 2, and the unitary knit construction of base structure 34 and adjustment member 36 is shown according to exemplary embodiments in FIGS. 19-22.

Figure 19:
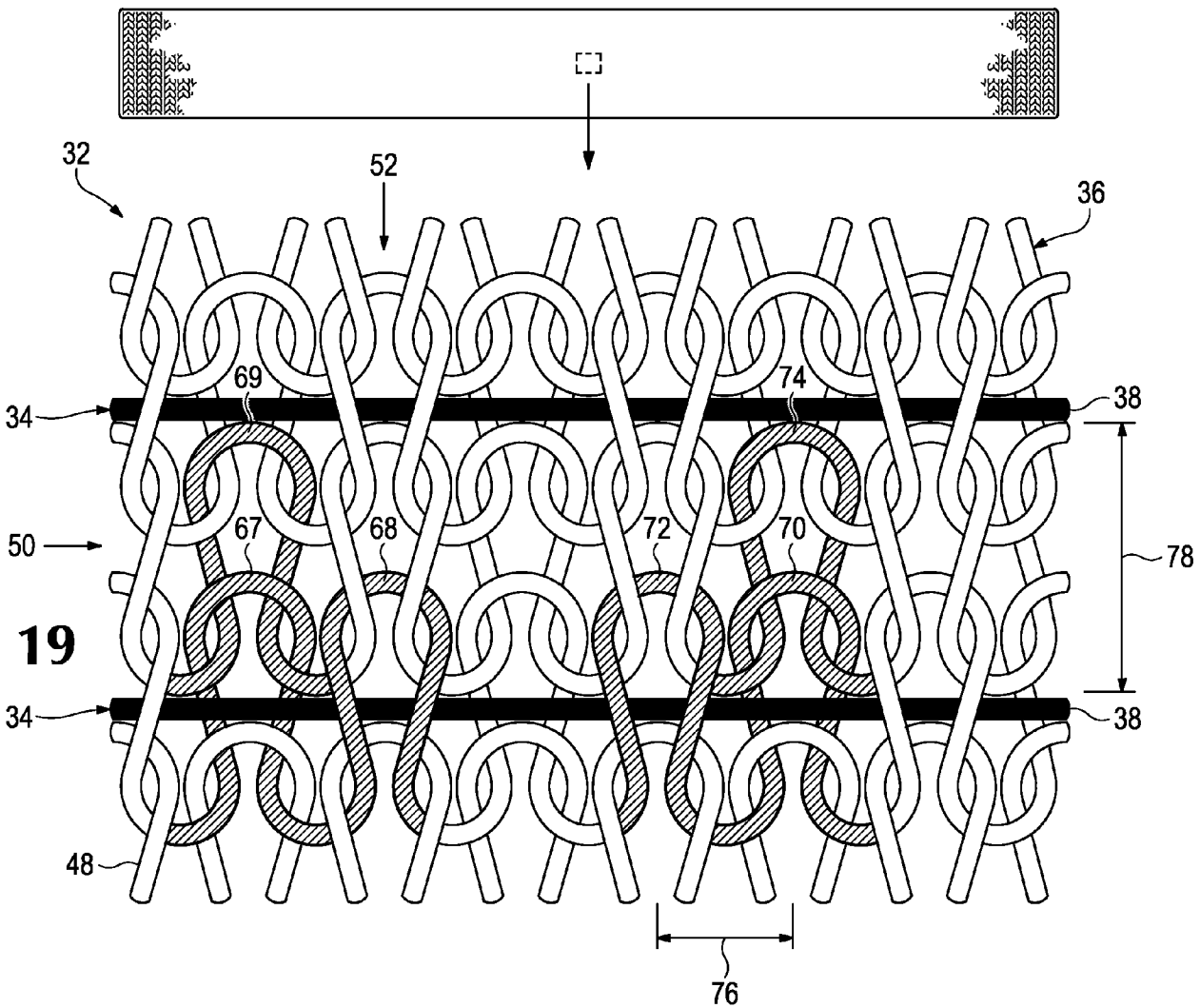
FIG. 19 is a detail view of a portion of the knitted component shown in a substantially smooth configuration.

As shown in FIG. 19, adjustment member 36 can include one or more yarns, cables, monofilaments, compound filaments, or other strands 48. Strands 48 can be made out of any suitable material, such as cotton, elastane, polymeric material, or combinations of two or more materials.

Strands 48 can be knitted and stitched together to define a plurality of interlocking loops that are arranged in respective courses and wales. A first loop 70, a second loop 72, and a third loop 74 are individually indicated in FIG. 19 for purposes of discussion. As shown, first loop 70 and second loop 72 are disposed in a common course 50 and are directly adjacent each other. Also, loop 70 and loop 74 are disposed in a common wale 52 and are directly adjacent each other. A loop distance between first loop 70 and second loop 72 is indicated by reference numeral 76. A loop height of third loop 74 is indicated by reference numeral 78.

Also, base structure 34 of knitted component 32 can include at least one yarn, cable, monofilament, compound filament, or other strand 38 as shown in FIGS. 2 and 19. Strand 38 can be integrally knit and secured to adjustment member 36 in any suitable fashion. For example, as shown in FIG. 19, strand 38 can be inlaid within and can extend through one or more courses 50 of adjustment member 36. Specifically, as shown in the illustrated embodiments, longitudinal sections 45 of strand 38 can be inlaid within different courses 50 of adjustment member 36. Stated differently, strand 38 can be alternatively disposed in front of and behind stitches as strand 38 extends along the respective course 50 as shown in FIG. 19. Accordingly, strand 38 can be substantially enclosed and encompassed by adjustment member 36. It will also be appreciated that strand 38 can be configured to extend along one or more wales 52 as well without departing from the scope of the present disclosure.

Strand 38 and other portions of knitted component 32 can incorporate the teachings of one or more of commonly-owned U.S. patent application Ser. No. 12/338,726 to Dua at al., entitled "Article of Footwear Having An Upper Incorporating A Knitted Component", filed on Dec. 18, 2008 and published as U.S. Patent Application Publication Number 2010/0154256 on Jun. 24, 2010, U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, U.S. patent application Ser. No. 13/781,336 to Podhajny, entitled "Method of Knitting A Knitted Component with a Vertically Inlaid Tensile Element", filed on Feb. 28, 2013 and published as U.S. Pat. No. 9,226,540 on Jan. 5, 2016, each of which is hereby incorporated by reference in its entirety.

The strands 48 of adjustment member 36 can be knitted to define a majority of article 10. Stated differently, strands 48 of adjustment member 36 can be knitted to define first edge 12, second edge 14, third edge 16, fourth edge 18, front face 20, and back face 22 of article 10.

Moreover, strand 38 can be routed through adjustment member 36 to support relative movement of adjustment member 36. Strand 38 of base structure 34 can be routed within adjustment member 36 in any suitable fashion and to extend across any suitable area of adjustment member 36. For example, as shown in the embodiments illustrated in FIG. 2, base structure 34 can extend between first edge 12 and second edge 14 as well as between third edge 16 and fourth edge 18.

More specifically, as shown in FIG. 2, strand 38 can have a first end 40, a second end 42, and a middle portion 44. First end 40 can be disposed adjacent first corner 24, and second end 42 can be disposed adjacent second corner 26. Middle portion 44 can extend in a serpentine fashion across adjustment member 36 to define a plurality of longitudinal sections 45 and a plurality of turns 46 as shown in FIG. 2. Longitudinal sections 45 can extend substantially parallel to third edge 16 and fourth edge 18, and longitudinal sections 45 can be spaced apart substantially evenly between third edge 16 and fourth edge 18. Also, turns 46 can be disposed adjacent either first edge 12 or second edge 14. Turns 46 can curve approximately one hundred and eighty degrees (180°) in some embodiments. The radius of turns 46 can have any suitable value. For example, the radius of the turns 46 can be between 0.05 and 0.25 inches.

Additionally, as shown in FIG. 2, adjustment member 36 and base structure 34 can be knitted together to define one or more supported areas 102 and one or more free areas 101, 103. It will be appreciated that base structure 34 extends through adjustment member 36 in the supported area 102, but base structure 34 is generally spaced away from free areas 101, 103.

It will be appreciated that the supported areas 102 and the unsupported areas 101, 103 can be disposed in any suitable location on knitted component 32. In the embodiments of FIG. 2, for example, supported area 102 is substantially centered between third edge 16 and fourth edge 18 and extends continuously between first edge 12 and second edge 14. Also, free area 101 extends along third edge 16 and extends continuously between first edge 12 and second edge 14. Moreover, free area 103 extends along fourth edge 18 and extends continuously between first edge 12 and second edge 14.

Also, first end 40 and second end 42 of strand 38 can be fixed to adjustment member 36. For example first end 40 and second end 42 can be knotted to adjustment member 36 in some embodiments. In additional embodiments, ends 40, 42 can be fixed with adhesives to adjustment member 36, or another fixation device can be used.

However, adjustment member 36 can be moveable relative to middle portion 44 of strand 38. Accordingly, portions of adjustment member 36 can slide over middle portion 44 of strand 38. For example, adjustment member 36 can slide along longitudinal sections 45 of strand 38 to allow adjustment member 36 to amass together and form bunched regions 54 shown in FIGS. 3, 4, 5, 20, and 21.

The bunching of adjustment member 36 into bunched region 54 and movement of bunched region 54 along article 10 relative to strand 38 of base structure 34 will be discussed in greater detail with reference to FIGS. 19-21. As shown in FIG. 19, when adjustment member 36 is smoothed, loop distance 76 and loop height 78 can be substantially consistent across adjustment member 36.

Figure 20:
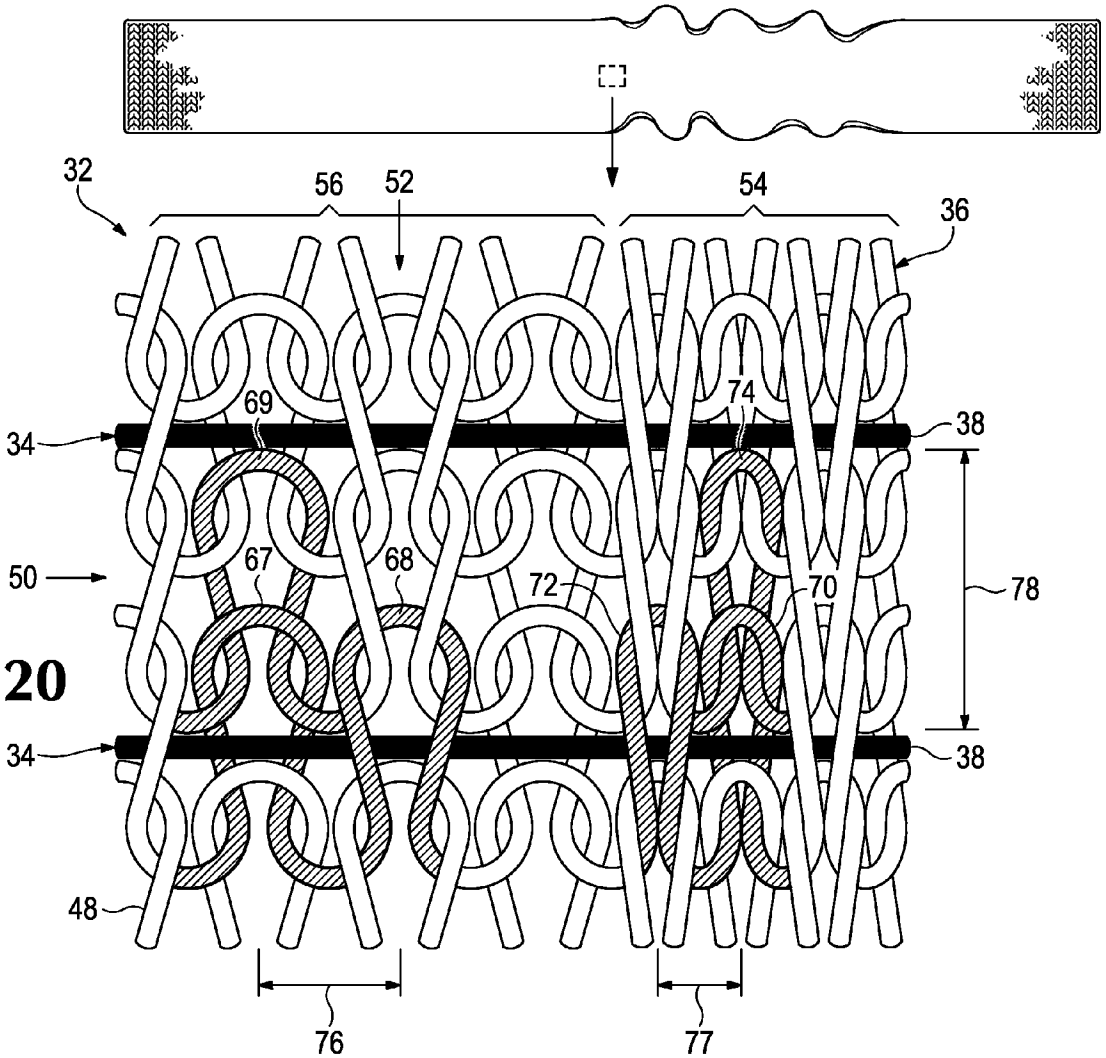
FIG. 20 is a detail view of the portion of the knitted component of FIG. 19 with a bunched region in a first position.

However, as shown in FIG. 20, adjustment member 36 can be amassed together and can slide over strand 38 of base structure 34 to create bunched region 54. More specifically, first loop 70 and second loop 72 can shift toward each other to reduce the respective loop distance 77 between first loop 70 and second loop 72. Likewise, the loop distance 77 can be reduced between other loops as shown in FIG. 20. Stated differently, slack between loops can be reduced when the user shifts the adjustment member 36 relative to strands 38 of base structure 34. Accordingly, adjustment member 36 can amass together to define bunched region 54. However, loop distance 76 between a fourth loop 67 and a fifth loop 68 within smoothed region 56 can remain substantially the same to that shown in FIG. 19.

Figure 21:
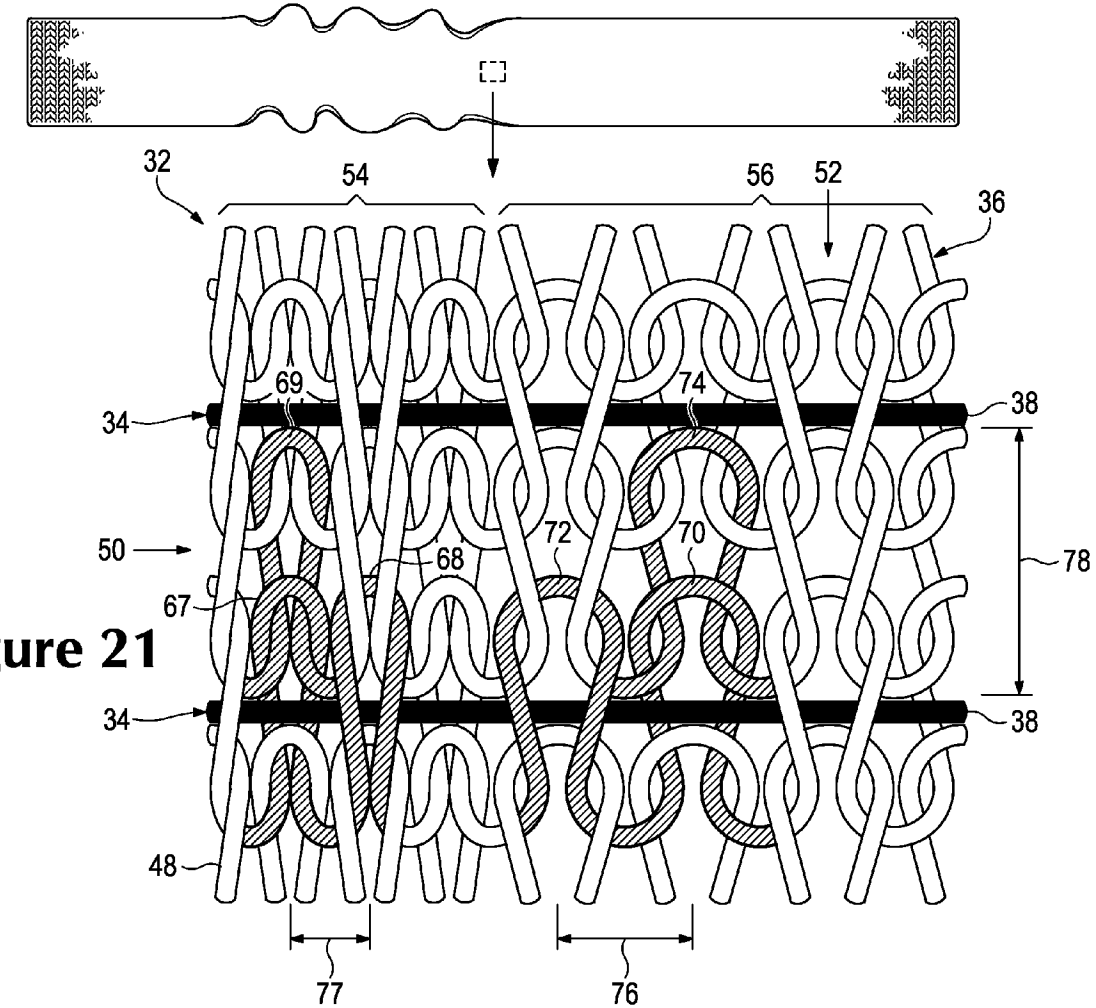
FIG. 21 is a detail view of the portion of the knitted component of FIGS. 19 and 20 with the bunched region in a second position.

Also, as shown in FIG. 21, bunched region 54 can be shifted in position. Stated differently, bunched region 54 can be defined on other portions of adjustment member 36. As shown in FIG. 21, first loop 70 and second loop 72 can be moved back away from each other to restore the loop distance 76 shown in FIG. 19. However, fourth loop 67 and fifth loop 68 can slide toward each other over strands 38 to reduce the respective loop distance 77.

Figure 22:
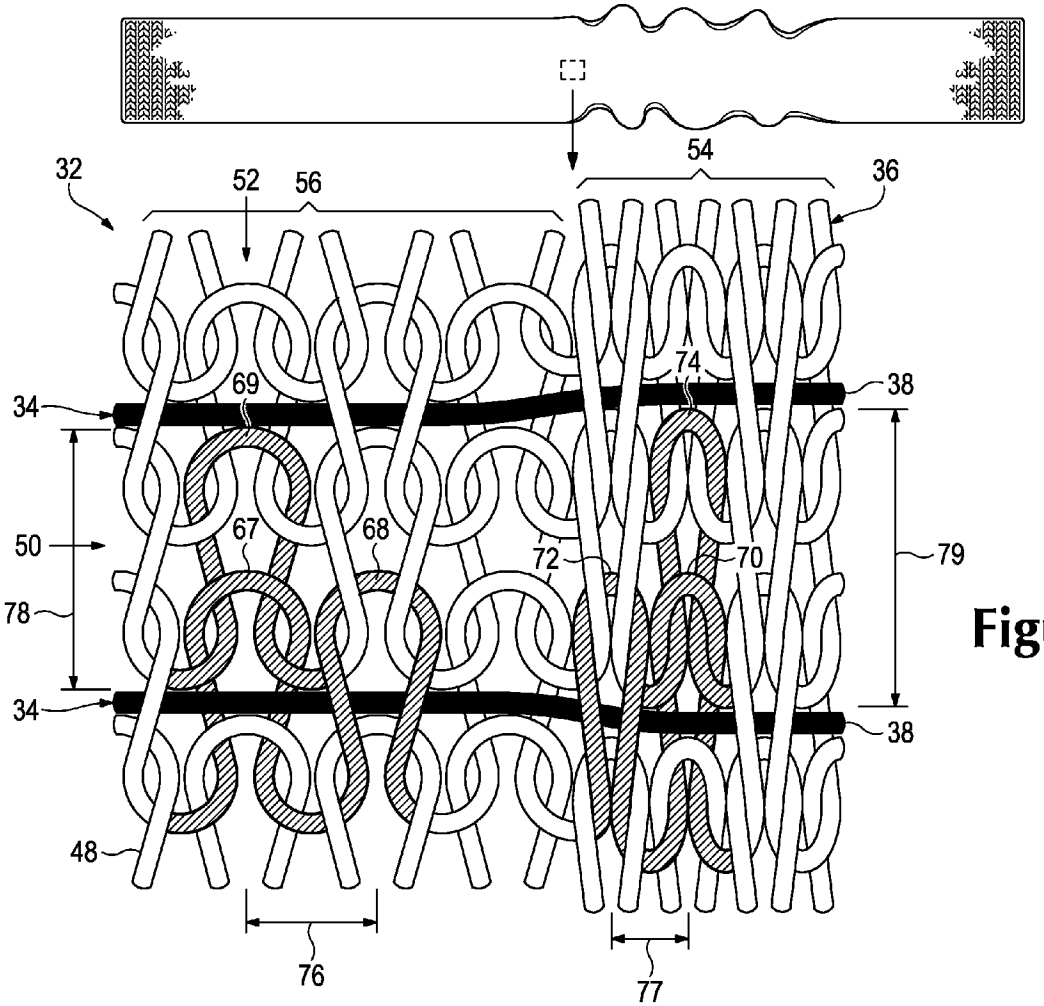
FIG. 22 is a detail view of the portion of the knitted component of FIGS. 19, 20, and 21 with the bunched region shown stretched in a vertical direction.

Furthermore, in some embodiments represented in FIG. 22, amassing loops within bunched region 54 can cause loop height to increase from loop height 78 to loop height 79. This can, in turn, push respective portions of longitudinal sections 45 of strand 38 further apart as shown. It will be appreciated that as bunched region 54 is shifted in position within knitted component 32, loop height can shift between loop height 78 and loop height 79.

Figure 23:
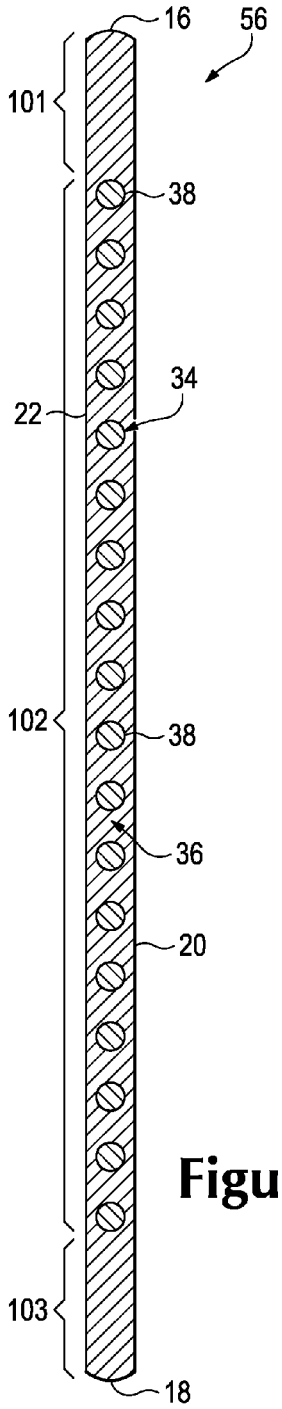
FIG. 23 is a section view of the knitted component taken along line 23-23 of FIG. 3.
Figure 24:
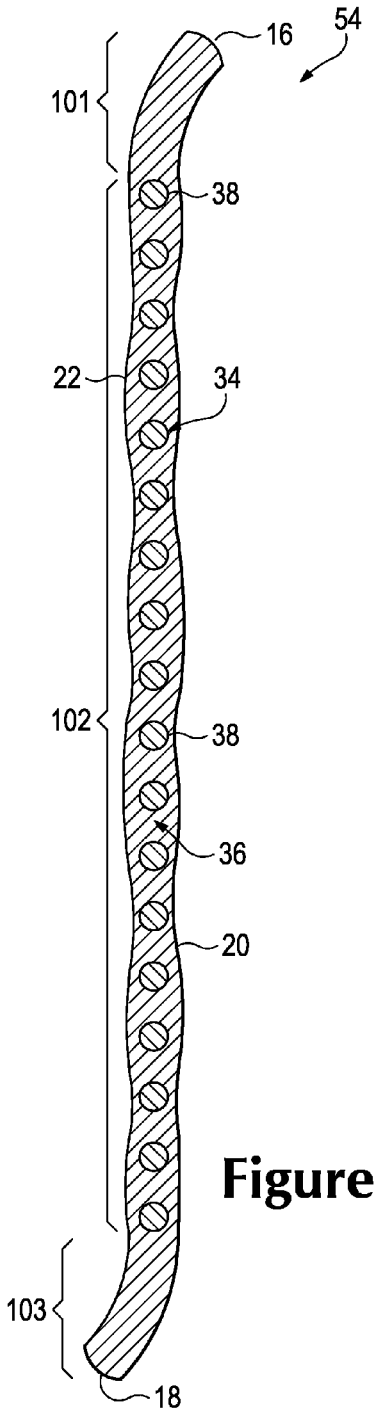
FIG. 24 is a section view of the knitted component taken along line 24-24 of FIG. 3.

FIG. 23 is a section view of knitted component 32 taken through smoothed region 56. As shown, free area 101, supported area 102, and free area 103 can be disposed substantially in a common plane. In contrast, FIG. 24 is a section view of knitted component 32 taken through bunched region 54. As shown, free area 101 and free area 103 can curve out of the plane defined by supported area 102. More specifically, strands 38 of support structure 34 can be rigid enough to substantially maintain supported area 102 in a substantially planar configuration. However, because strands 38 do not extend through free area 101 and free area 103, free area 101 and free area 103 can curve to a much larger extent. Thus, as shown in FIG. 3, third edge 16 and fourth edge 18 can curve, fold in on itself, or otherwise contour to a large degree within bunched region.

Figure 25:
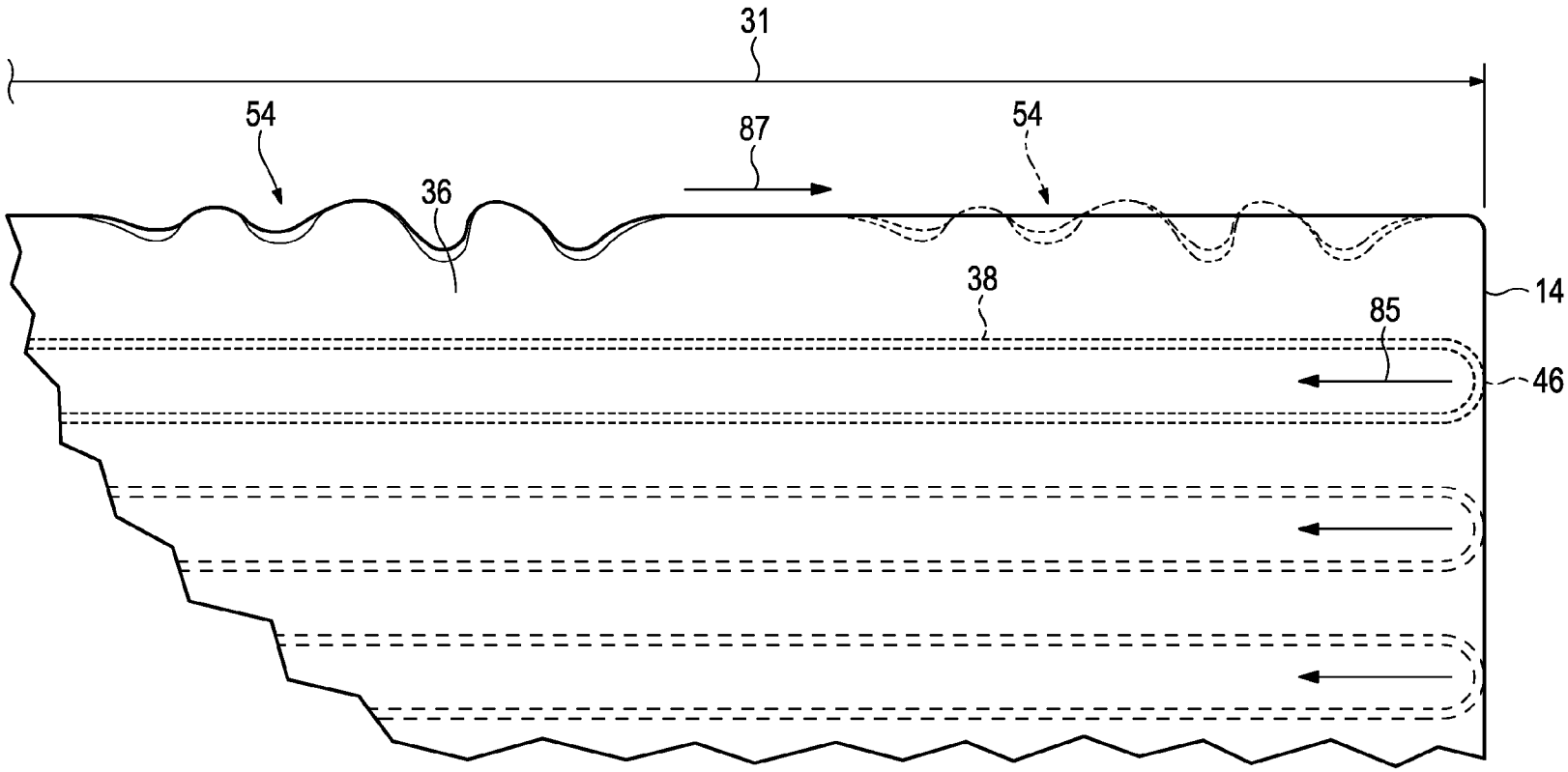
FIG. 25 is a detail view of an exemplary corner of the knitted component shown with an adjustment member of the knitted component being moved relative to a base structure of the knitted component.

In some embodiments, the length 31 of knitted component 32 can be substantially fixed. For example, strand 38 of base structure 34 can have a substantially fixed length and can be nonextendable such that strand 38 prevents or inhibits stretching and elongation of knitted component 32. More specifically, as shown in FIG. 25, bunched region 54 is shown with broken lines sliding toward second edge 14 as indicated by arrow 87. However, as bunched region 54 reaches second edge 14, strand 38 resists stretching and turns 46 exert a reaction force 85 against adjustment member 36 that opposes the direction of movement of adjustment member 36. Accordingly, length 31 of knitted component 32 can remain fixed. Thus, sliding movement of bunched region 54 can be limited by turns 46. It will be appreciated that turns 46 disposed at first edge 12 can similarly limit elongation of knitted component 32.

It will be appreciated that strand 38 of base structure 34 can be particularly selected to have characteristics that allow adjustment member 36 to adjust as discussed above. As such, strand 38 can have some flexibility, but strand 38 can be stiff enough to maintain the longitudinal sections 45 relatively straight as bunched regions 54 are formed in adjustment member 36 and shifted along knitted component 32. Accordingly, longitudinal sections 45 of strand 38 can guide movement and bunching of bunched region 54 along article 10. Also, strand 38 can have a desirable coefficient of friction for allowing adjustment of adjustment member 36. Specifically, the coefficient of friction can be low enough to facilitate sliding of adjustment member 36 over strand 38, and yet the coefficient of friction can be high enough to hold the adjustment member 36 in its selected position. In some embodiments, strand 38 can be a polymeric monofilament strand, such that strand 38 provides these and other desirable characteristics.

Figure 6:
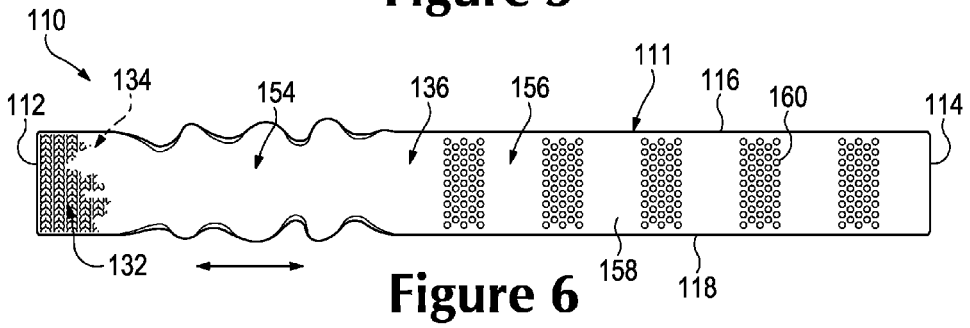
FIG. 6 is a front view of an additional embodiment of the article according to exemplary embodiments of the present disclosure.

Additional embodiments of article 110 and knitted component 132 are illustrated in FIG. 6. Components that correspond to those discussed above are indicated with corresponding reference numbers increased by 100.

As shown, article 110 can be substantially similar to the embodiments discussed above. However, knitted component 132 can include a plurality of zones that differ from each other in one or more characteristics. These zones can differ in appearance, such that the zones differ in color, stitching pattern, or in other way. The zones can also differ in physical or mechanical characteristics in additional embodiments. For example, the zones can differ in elasticity in some embodiments.

In the embodiments illustrated, for example, adjustment member 136 of knitted component 132 can include a first zone 158 and a second zone 160. First zone 158 can have a stitch density that is greater than the stitch density of second zone 160. More specifically, first zone 158 can have a full gauge knit while second zone 160 can have a 1×1 mesh stitching pattern. Also, as shown, first zone 158 and second zone 160 can be disposed in an alternating arrangement along knitted component 132 between first edge 112 and second edge 114. Accordingly, second zone 160 can allow for increased airflow through the article 110, and article 110 can be comfortable to wear against skin.

In additional embodiments, first zone 158 can have a higher stitch density than second zone 160 such that first zone 158 resists sliding along base structure 34 more than second zone 160. Additionally, first zone 158 and second zones 160 can be constructed from different types of yarns to differentiate the characteristics between first zone 158 and second zone 160. For example, first zone 158 can be constructed from an elastic yarn while second zone 160 can be constructed from a substantially inelastic yarn. The yarns of first zone 158 and second zone 160 can also differ in color. Furthermore, the yarns can differ in texture, denier, bulk, or other characteristic.

Embodiments of Articles Incorporating Knitted Component

As mentioned above, articles 10 of the type shown in FIG. 1 can be incorporated within or can define a strap 11. Such a strap 11 could be used as an athletic support strap or bandage in some embodiments. For example, the strap 11 could be wrapped around an ankle, wrist, or other joint to apply compression to the joint. This compression can limit movement of the joint, for example, if the joint is sprained. Also, as discussed above, the position of bunched region 54 on strap 11 can be adjusted such that cushioning is applied by the bunched region 54 at a desirable location.

In additional embodiments, strap 11 can be included on other articles. For example, as shown in FIG. 14, strap 11 can be included on an article of footwear 13. Strap 11 can be included anywhere on footwear 13 and can be used for any suitable purpose.

Figure 15:
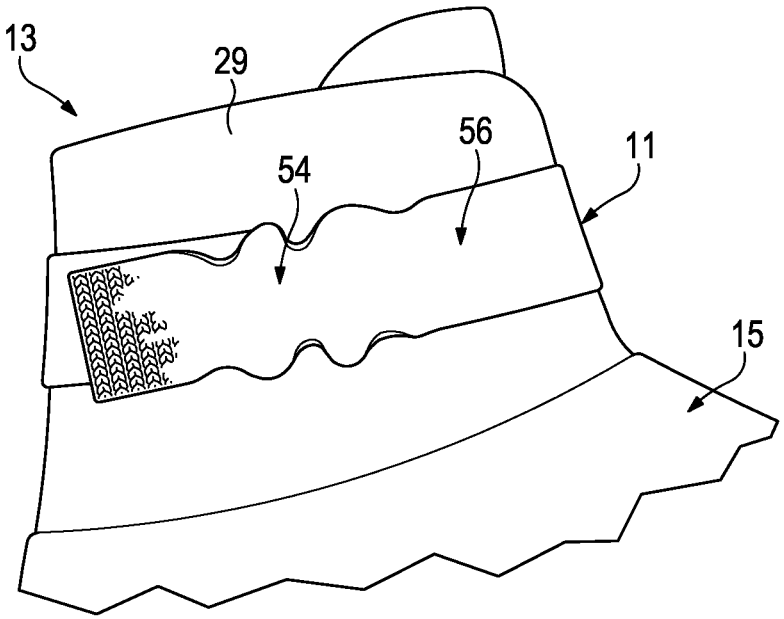
FIG. 15 is a side view of the article of FIG. 14 with a bunched region shown in a first position.
Figure 16:
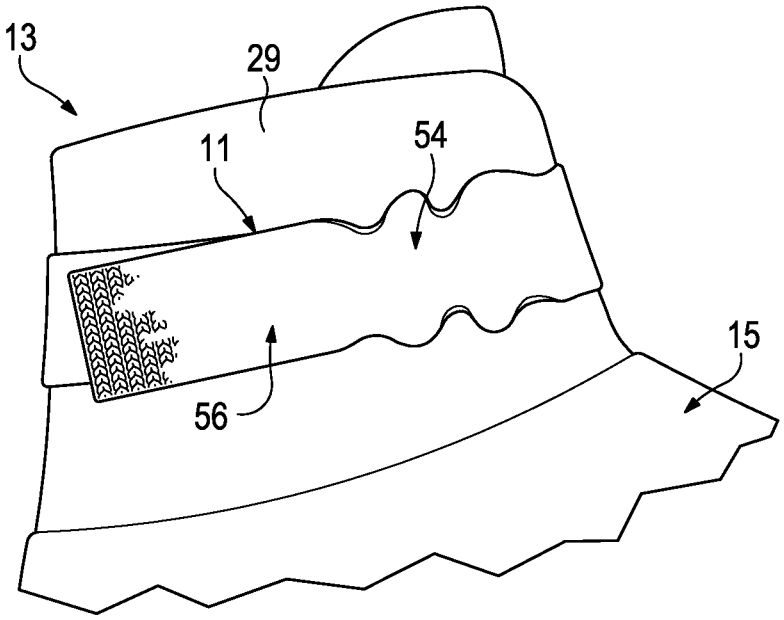
FIG. 16 is a side view of the article of FIG. 14 with the bunched region shown in a second position.

For example, footwear 13 can generally include an upper 15 and a sole structure 17, and strap 11 can be included on upper 15. More specifically, in some embodiments, upper 15 can include an ankle opening 29 configured to receive the wearer's foot, and strap 11 can be attached adjacent ankle opening 29. In some embodiments, one end of the strap 11 can be fixed to upper via adhesives, fasteners, or other attachment device, and the free portion of strap 11 can be wrapped about the wearer's ankle as shown in FIGS. 15 and 16. In some embodiments, strap 11 can also include a fastening device, such as a buckle, pile and loop tape, or other similar implement for securing the free end in this wrapped position. Also, by comparing FIGS. 15 and 16, it will be apparent that bunched region 54 can be shifted along the length of strap 11. Thus, the cushioning provided by bunched region 54 can be shifted and adjusted.

Moreover, strap 11 can be included on articles of apparel, such as undergarments, pants, shorts, tank tops, belts, hats, or other articles of apparel. The strap 11 can help support the article of apparel on the wearer's body, and the adjustability of the strap 11 can allow the wearer to configure the strap 11 in a variety of ways.

As shown in the embodiment illustrated in FIG. 17, strap 11 is included on an undergarment, such as a brassiere 19. Brassiere 19 can include a body 21 with cups 23. Strap 11 can be configured to extend over the shoulder of the wearer as shown, or strap 11 can be configured to extend across the back of the wearer. In either case, strap 11 can support cups 23 on the wearer's body. The strap 11 can be configured to include bunched region 54. As discussed above, bunched region 54 can be shifted. As such, bunched region 54 can be moved to a desirable location to provide needed cushioning against the wearer's skin.

Furthermore, as shown in FIG. 18, strap 11 is included on a belt 25. Belt 25 can include a fastening device 27 that attaches the two ends of belt 25 for securing belt 25 about the waist of the wearer. Fastening device 27 can be of any suitable type. For example, fastening device 27 can include a buckle as shown in FIG. 18. Fastening device 27 can also include pile tape, a hook, buttons, or other similar device. Also, as shown in FIG. 18, bunched region 54 of strap 11 can be shifted along belt 25 as discussed in detail above.

In still additional embodiments, strap 11 can be included on articles of equipment. For example, strap 11 can be included on a shoulder strap of a bag or other container.

As mentioned above, knitted component 32 can be shaped in various ways, and knitted component 32 can be included in other articles other than a strap. It will be appreciated that shape, dimensions, and other characteristics of knitted component 32 can be altered and reconfigured in many ways according to the use and function of the knitted component 32. It will also be appreciated that the knitting process can be highly adaptable and can accommodate these variations.

Embodiments of Knitting Process

Embodiments of the method of manufacture of knitted component 32 will now be discussed. Knitted component 32 can be manufactured in any suitable fashion. For example, as shown in embodiments represented in FIGS. 7-13, knitted component 32 can be automatically knitted on a knitting machine 200. For example, knitting machine 200 can be a flat knitting machine as represented in FIGS. 7-13. It will be appreciated that knitting machine 200 is shown partially in FIGS. 7-13.

As shown, knitting machine 200 can include one or more first feeders 204 and one or more second feeders 220. First feeder 204 can be of a conventional type known in the art. Also, second feeder 220 can be configured according to the teachings of U.S. patent application Ser. No. 13/048,527 to Huffa, entitled "Combination Feeder for a Knitting Machine", and published as U.S. Patent Publication No. 2012-0234051 on Sep. 20, 2012, which is incorporated by reference in its entirety.

Feeders 204, 220 can be supported and suspended from rail 203. Feeders 204, 220 can also be supported for movement along the rail 203. Whereas second feeder 220 is secured to a front side of rail 203, first feeder 204 is secured to a rear side of rail 203.

Knitting machine 200 can also include a plurality of needles 202 of a known type that are arranged in respective rows or beds below the rail 203. As will become apparent, first feeder 204 can feed strand 48 to needles 202 for forming adjustment member 36. In contrast, second feeder 220 can feed strand 38 toward needles 202 for forming base structure 34.

The knitting process discussed herein relates to the formation of knitted component 32, which may be any knitted component, including knitted components that are similar to knitted component 32 discussed above. For purposes of the discussion, only a relatively small section of knitted component 32 adjacent second edge 14 is shown in FIGS. 7-13. It will be appreciated that first edge 12 and other portions of knitted component 32 can be similarly constructed. Moreover, the scale or proportions of the various elements of knitting machine 200 and knitted component 32 may be enhanced in FIGS. 7-13 to better illustrate the knitting process.

Figure 7:
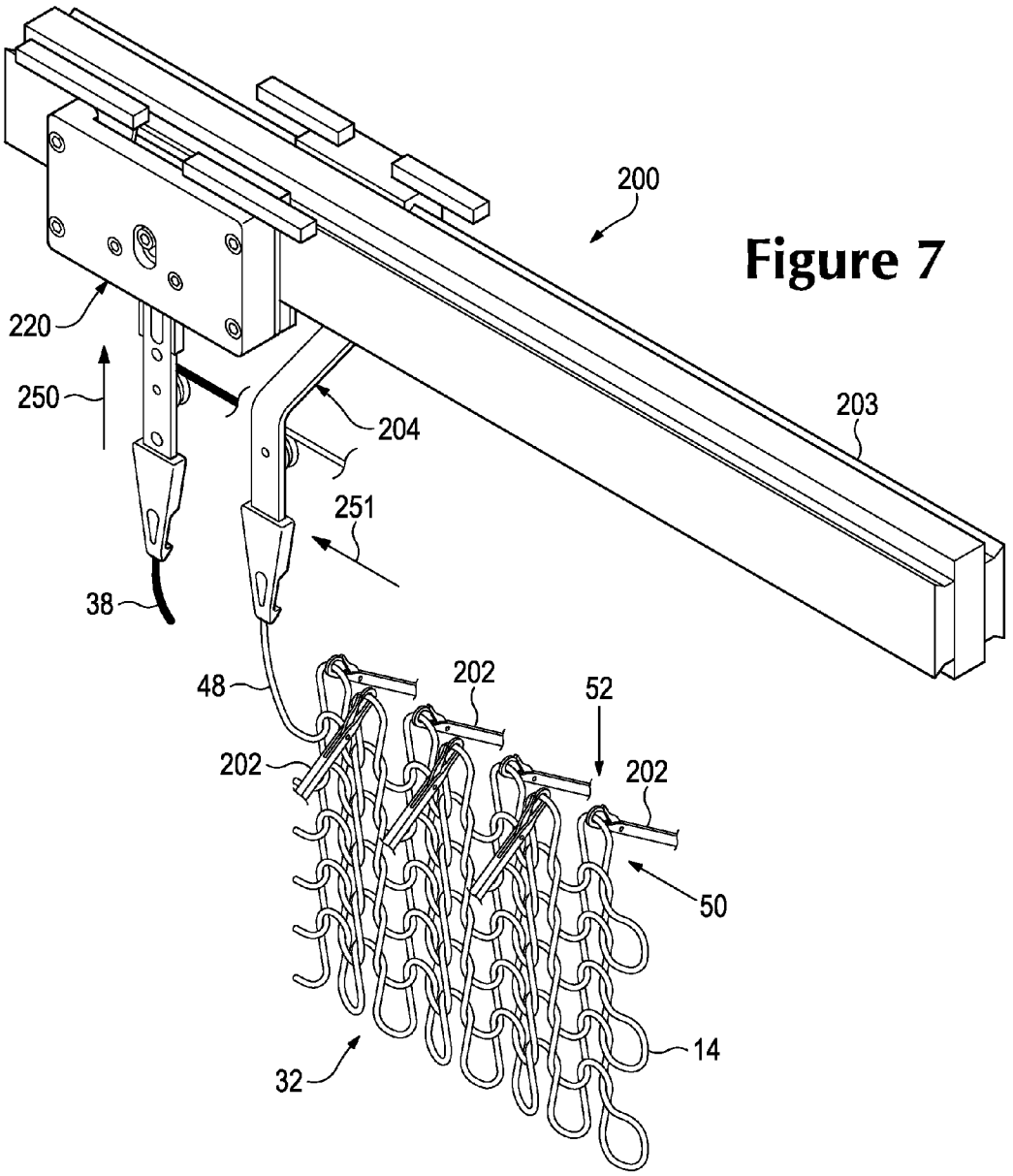
FIGS. 7-13 are perspective schematic views of a portion of a knitting machine shown during manufacture of the article of FIG. 1.

As shown in FIG. 7, first feeder 204 can move along rail 203 in the direction of arrow 251, and a new course 50 can be formed in knitted component 32 from strand 48. More particularly, needles 202 can pull sections of strand 48 through the loops of the prior course, thereby forming the new course 50. Accordingly, courses may be added to knitted component 32 by moving first feeder 204 along needles 202, thereby permitting needles 202 to manipulate strand 48 and form additional loops from strand 48.

Figure 8:
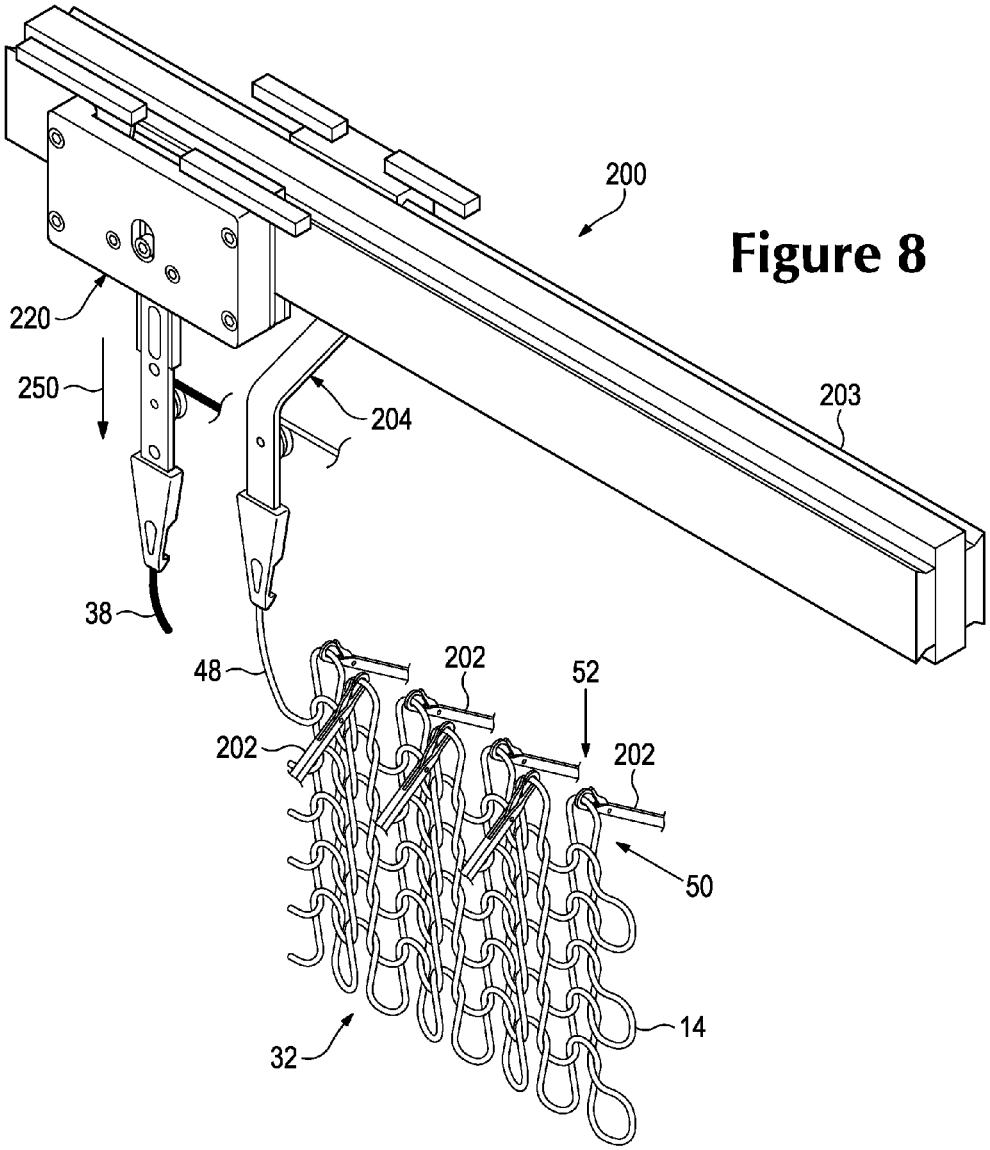
Figure 9:
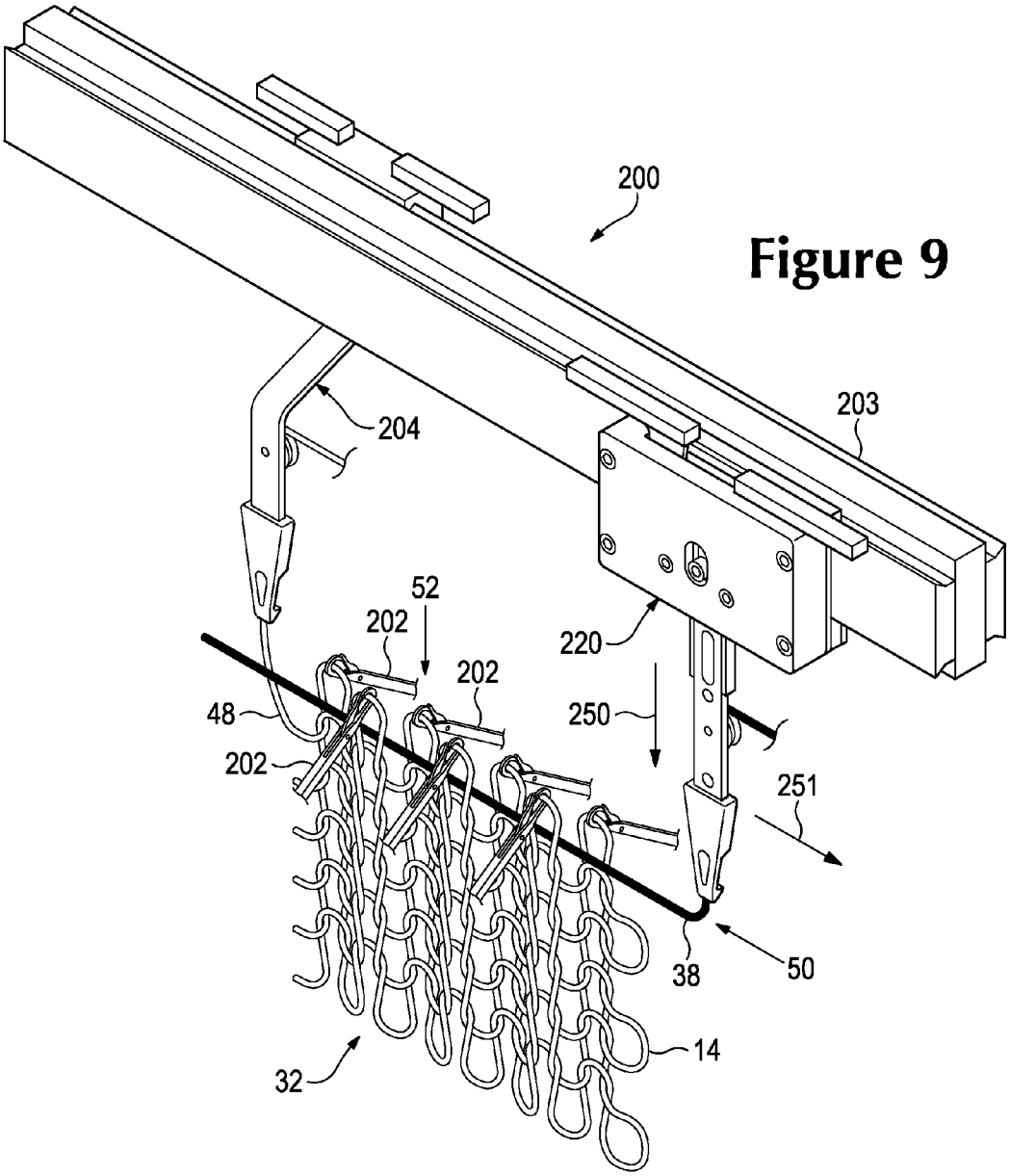

Continuing with the knitting process, second feeder 220 now translates from the retracted position to an extended position, as depicted by arrow 250 in FIG. 8. In this extended position, tip of feeder 220 can be disposed closer to needles 202. Then, as shown in FIG. 9, second feeder 220 moves along rail 203 and strand 38 can be placed between loops of knitted component 32. That is, strand 38 can be positioned in front of some loops and behind other loops in an alternating pattern. Moreover, strand 38 can be placed in front of loops being held by needles 202 from one needle bed, and strand 38 can be placed behind loops being held by needles 202 from the other needle bed. Note that second feeder 220 can remain in the extended position in order to lay strand 38 in the area below the intersection of needle beds. This effectively places strand 38 within the course recently formed by first feeder 204 in FIG. 7.

Figure 10:
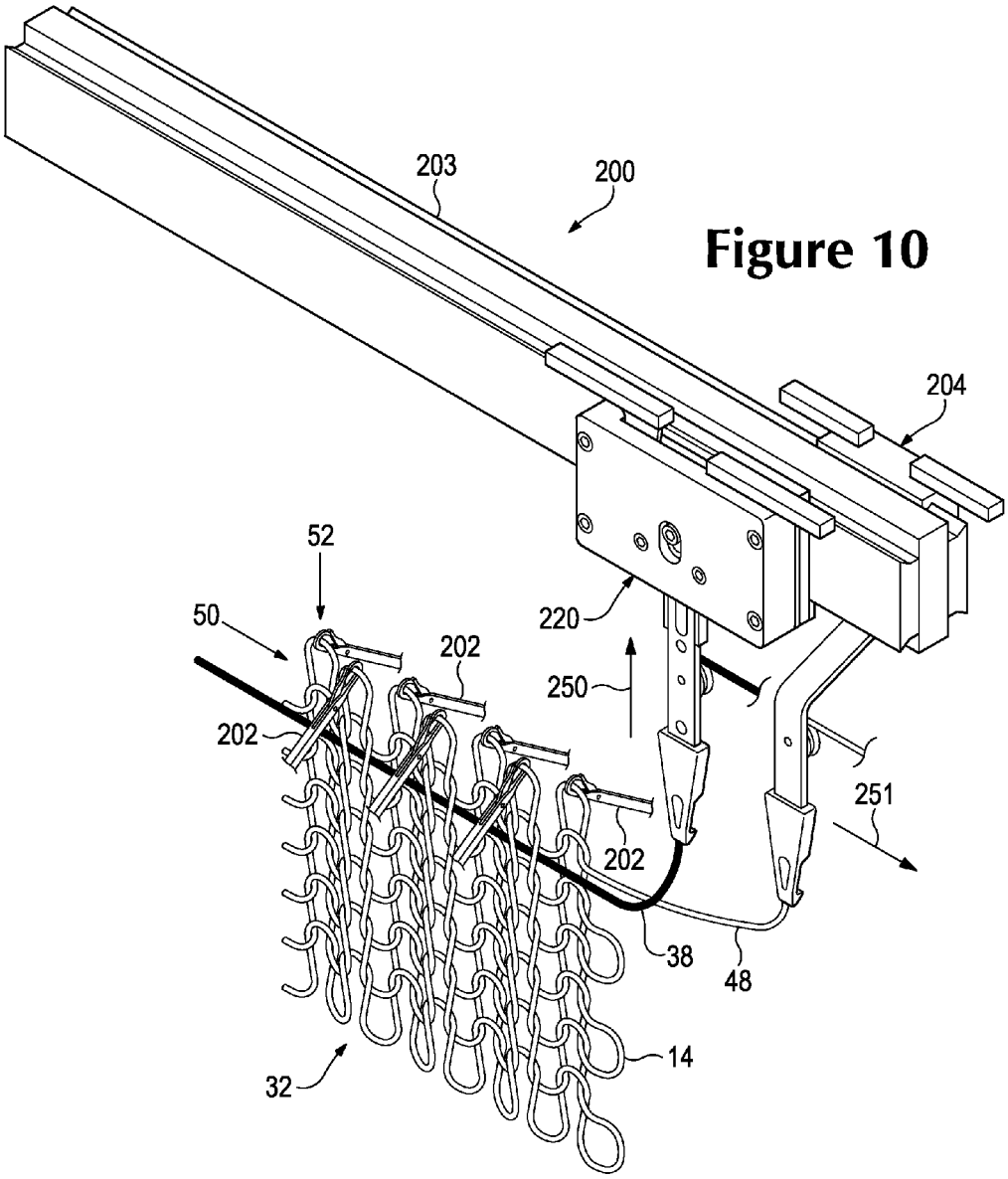

In order to complete inlaying strand 38 into knitted component 32, first feeder 204 can move along rail 203 to form a new course 50 from strand 48, as depicted in FIG. 10. By forming the new course 50, strand 48 is effectively knit within or otherwise integrated into the unitary knit construction of knitted component 32. At this stage, second feeder 220 may also translate from the extended position to the retracted position as depicted by arrow 250 in FIG. 10.

Figure 11:
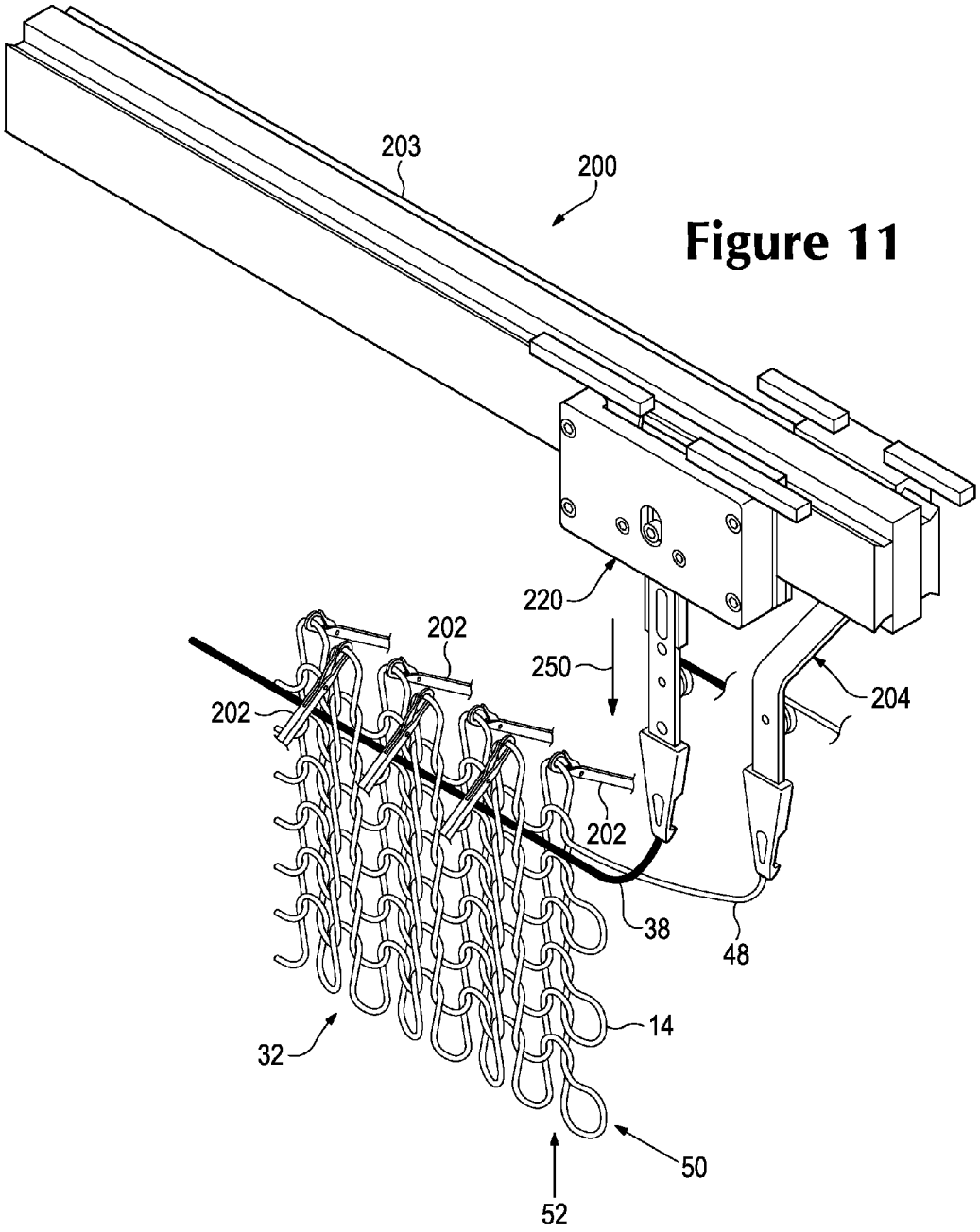
Figure 12:
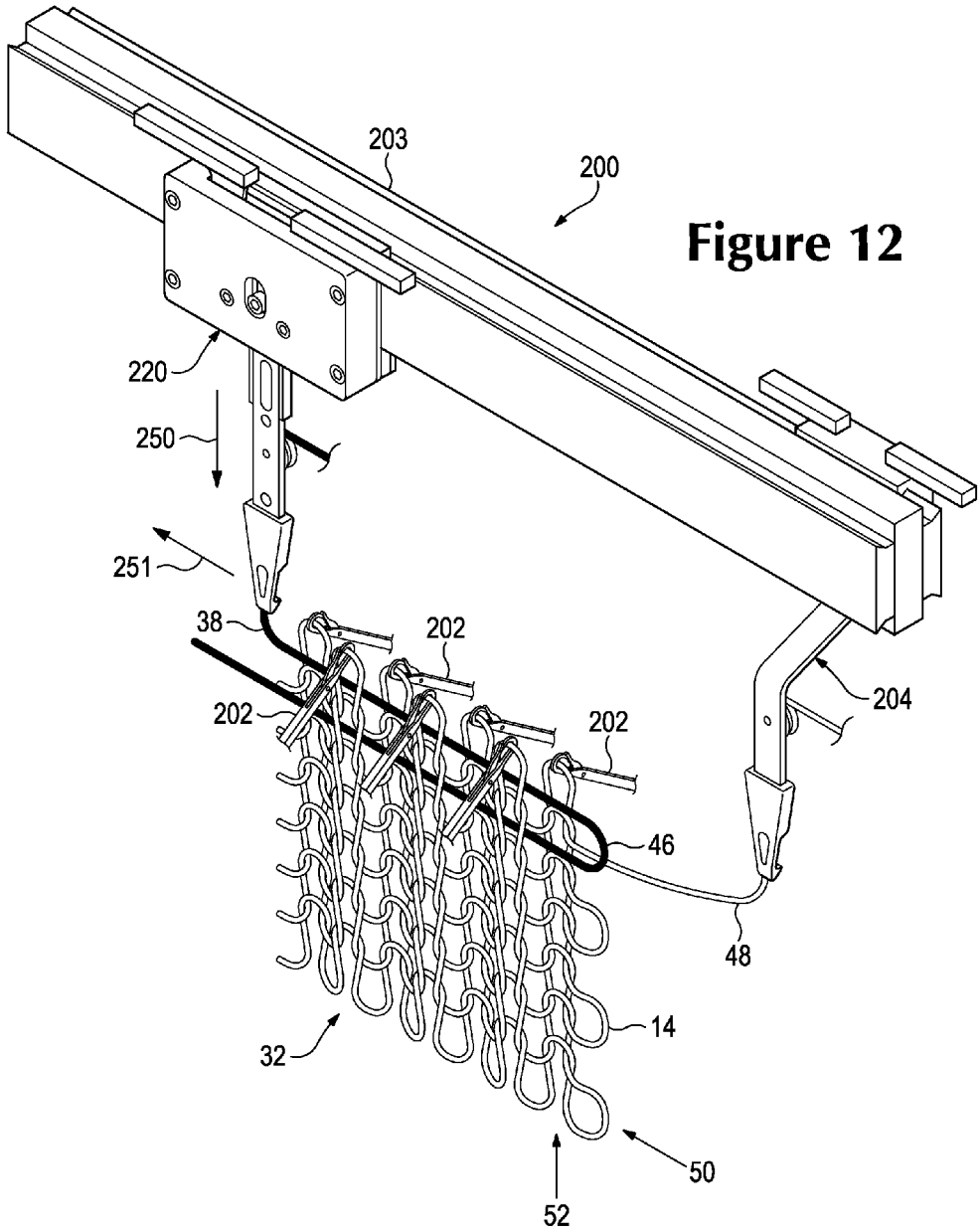
Figure 13:
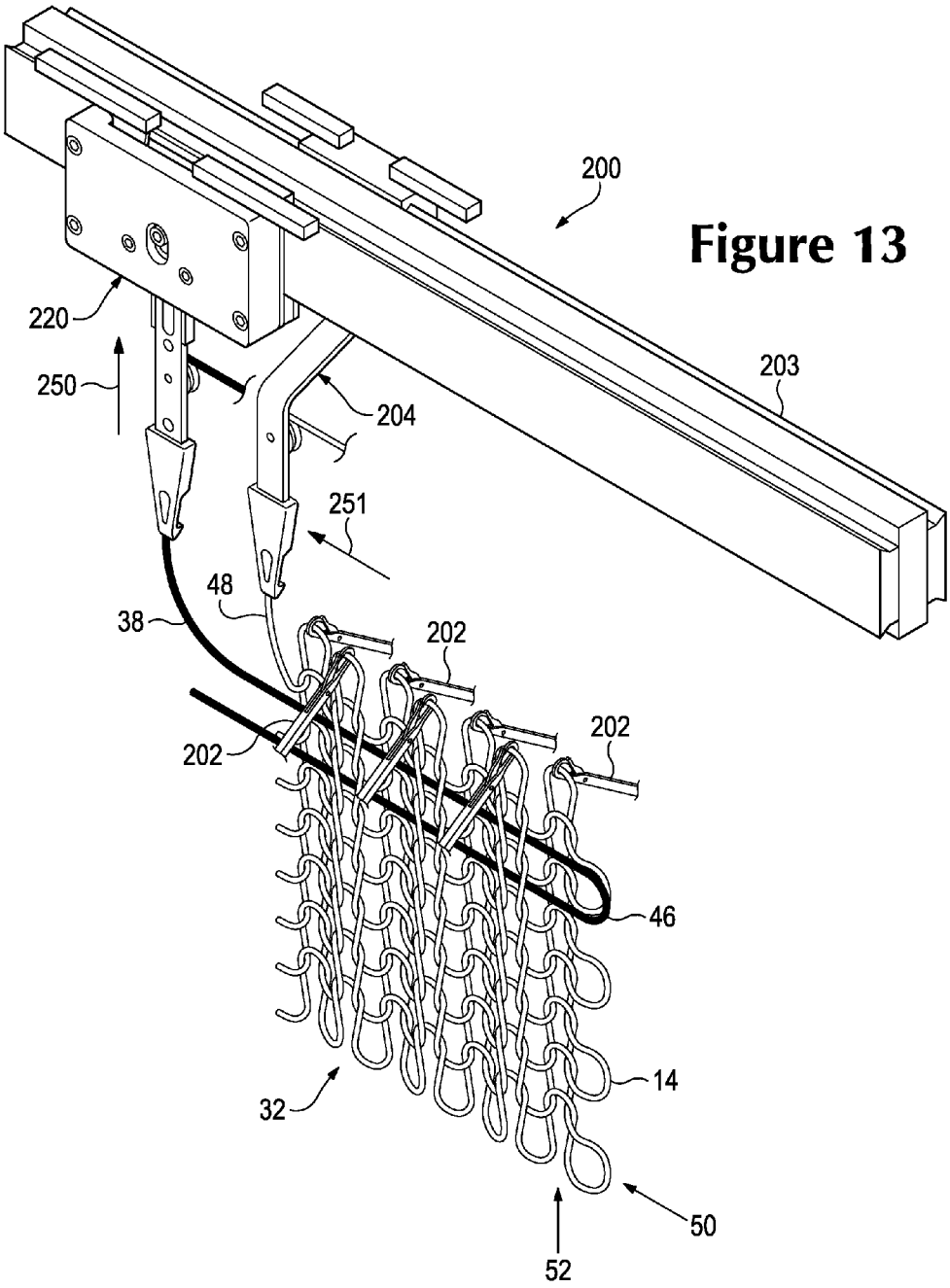

Continuing with the knitting process, second feeder 220 can translate from the retracted position to the extended position, as depicted by arrow 250 in FIG. 11. Second feeder 220 can then move along rail 203 in the direction of arrow 251 in FIG. 12. As such, turn 46 can be formed, and strand 38 can be placed between loops of knitted component 32, as depicted in FIG. 12. This effectively places strand 38 within the course 50 formed by first feeder 204 in FIG. 10. Then, in order to complete inlaying strand 38 into knitted component 32, first feeder 204 can move along rail 203 to form a new course 50 from strand 48 as depicted in FIG. 13. By forming the new course 50, strand 38 can be integrated into the unitary knit construction of knitted component 32. This process can be repeated until knitted component 32 is fully formed.

It will be appreciated, thus, that knitted component 32 can be manufactured in an efficient manner. Once formed, the knitted component 32 can be further processed to form the desired article.

In summary, knitted component 32 can be highly adjustable by the user. For example, knitted component 32 can be changed from a relatively smooth and uniform configuration to include at least one bunched region 54. This bunched region 54 can be shifted along the knitted component. Accordingly, the knitted component 32 may be useful for articles that are intended to be disposed adjacent the user's body, and the bunched region 54 can be shifted to provide cushioning to a desired area on the user's body.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

We claim:

1. An article comprising:

a knitted component of unitary knit construction, the knitted component having a first edge and a second edge, the knitted component having a length that is measured between the first edge and the second edge, the length being substantially fixed, the knitted component including:

a base structure being substantially inelastic, an adjustment member that is integrally knit to the base structure, the adjustment member including a bunched region that is configured to slide along the base structure between a first position on the knitted component and a second position on the knitted component, and a supported area and at least one free area, wherein the base structure extends through the supported area and the base structure is spaced from the at least one free area.

2. The article of claim 1, wherein the bunched region is closer to the first edge in the first position, and wherein the bunched region is closer to the second edge in the second position.

3. The article of claim 2, wherein the base structure includes at least one strand that has a substantially fixed length and that limits the elongation of the length of the knitted component.

4. The article of claim 3, wherein the at least one strand extends in a serpentine pattern between the first edge and the second edge.

5. The article of claim 4, wherein the knitted component includes a third edge and a fourth edge that each extend between the first edge and the second edge, the first edge and the second edge being opposite from each other, and the third edge and the fourth edge being opposite from each other, the at least one strand having a first end and a second end, the at least one strand including a middle portion between the first end and the second end, the middle portion including a plurality of turns, the first end disposed adjacent the third edge, the second end disposed adjacent the fourth edge, each of the plurality of turns disposed adjacent one of the first edge and the second edge.

6. The article of claim 3, wherein the at least one strand is a monofilament.

7. The article of claim 1, wherein the base structure includes at least one strand, wherein the adjustment member includes a knitted course and a knitted wale, and wherein the at least one strand is inlaid within at least one of the knitted course and the knitted wale.

8. The article of claim 1, wherein the at least one free area exhibits more curvature than the supported area in the bunched region.

9. The article of claim 8, wherein the knitted component also includes a third edge that extends between the first edge and the second edge, wherein the at least one free area and the supported area both extend substantially continuously between the first edge and the second edge, wherein the at least one free area extends along the third edge, and wherein the supported area is spaced from the third edge.

10. The article of claim 9, wherein the at least one free area includes a first free area and a second free area, wherein the knitted component also includes a fourth edge that extends between the first edge and the second edge, the fourth edge being opposite the third edge, wherein the first free area extends along the third edge, wherein the second free area extends along the fourth edge, and wherein the supported area is spaced from the third edge and the fourth edge.

11. The article of claim 1, wherein the article is an article of footwear further comprising an upper and a sole structure that are coupled together, the article of footwear also including a strap that is coupled to the upper, the strap including the knitted component.

12. The article of claim 1, wherein the article is an article of apparel further comprising a body and a support strap that is configured to support the body.

13. The article of claim 12, wherein the article of apparel is a brassiere.

14. The article of claim 1, wherein the article is a belt that includes the knitted component and a fastening device.

15. An article comprising:

a strap having a first edge and a second edge and a length measured between the first edge and the second edge, wherein the length is substantially fixed, the strap including a knitted component of unitary knit construction, the knitted component including:

a base structure that includes at least one strand, an adjustment member that is integrally knit to the base structure, the adjustment member including a bunched region that is configured to slide along the at least one strand between a first position on the knitted component and a second position on the knitted component, wherein the bunched region is closer to the first edge in the first position, and wherein the bunched region is closer to the second edge in the second position, and a supported area and at least one free area, wherein the base structure extends through the supported area and the base structure is spaced from the at least one free area;

wherein the at least one strand is fixed to the adjustment member.

16. The article of claim 15, wherein the at least one strand has a substantially fixed length, the at least one strand configured to limit the elongation of the length of the knitted component.

17. The article of claim 15, wherein the at least one strand extends in a serpentine pattern between the first edge and the second edge.

18. The article of claim 17, wherein the knitted component includes a third edge and a fourth edge that each extend between the first edge and the second edge, the first edge and the second edge being opposite from each other, and the third edge and the fourth edge being opposite from each other, the at least one strand having a first end and a second end, the at least one strand including a middle portion between the first end and the second end, the middle portion including a plurality of turns, the first end disposed adjacent the third edge, the second end disposed adjacent the fourth edge, each of the plurality of turns disposed adjacent one of the first edge and the second edge.

19. The article of claim 15, wherein the at least one strand is a monofilament.

20. The article of claim 15, wherein the adjustment member includes a knitted course and a knitted wale, and wherein the at least one strand is inlaid within at least one of the knitted course and the knitted wale.

21. The article of claim 15, wherein the article is a belt that includes strap and a fastening device that is coupled to the strap.

22. The article of claim 1, wherein the base structure includes an inlaid strand secured to the adjustment member.

23. The article of claim 15, wherein the at least one strand of the base structure is substantially inelastic.

* * * * *